US006712660B2

(12) United States Patent
Aoki et al.

(10) Patent No.: US 6,712,660 B2
(45) Date of Patent: Mar. 30, 2004

(54) METHOD AND APPARATUS FOR ADJUSTING CHARACTERISTICS OF ELECTRON SOURCE, AND METHOD FOR MANUFACTURING ELECTRON SOURCE

(75) Inventors: Shuji Aoki, Kanagawa (JP); Takahiro Oguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 10/209,876

(22) Filed: Aug. 2, 2002

(65) Prior Publication Data

US 2003/0036331 A1 Feb. 20, 2003

(30) Foreign Application Priority Data

Aug. 6, 2001 (JP) ..... 2001-237261

(51) Int. Cl.[7] ..... H01J 9/02
(52) U.S. Cl. ..... 445/3; 445/6
(58) Field of Search ..... 445/3, 6, 24

(56) References Cited

U.S. PATENT DOCUMENTS 5,591,061 A * 1/1997 Ikeda et al. ..... 445/3
5,998,924 A 12/1999 Yamamoto et al. ..... 313/496
6,144,350 A 11/2000 Fujii et al. ..... 345/74
6,149,480 A 11/2000 Iwasaki et al. ..... 445/6
6,184,851 B1 2/2001 Yamaguchi et al. ..... 345/75.2
6,231,412 B1 5/2001 Kawade et al. ..... 445/3
2003/0057850 A1 * 3/2003 Aoki et al. ..... 315/169.1

FOREIGN PATENT DOCUMENTS

| | | |
|---|---|---|
| EP | 0 803 892 A2 | 10/1997 |
| JP | 8-96700 | 4/1996 |
| JP | 10-228867 | 8/1998 |
| JP | 2000-243256 | 9/2000 |

* cited by examiner

*Primary Examiner*—Kenneth J. Ramsey
(74) *Attorney, Agent, or Firm*—Fitzpatrick, Cella, Harper & Scinto

(57) ABSTRACT

A method for adjusting characteristics of an electron source having a plurality of electron-emitting devices, and a method for manufacturing the electron source include the step of applying a pulse of a voltage for adjustment to an electron-emitting device to be adjusted one or more times according to a characteristic of the electron-emitting device, wherein the voltage for adjustment is selected from a plurality of voltages having discrete values according to the characteristic of the electron-emitting device, and a number of applying times of the pulse is determined according to the characteristic of the electron-emitting device and the selected voltage.

15 Claims, 13 Drawing Sheets

PRELIMINARY DRIVE PROCESSING
SET ADJUSTING TARGET VALUE

PRODUCING LOOK-UP TABLE

METHOD AND APPARATUS FOR ADJUSTING CHARACTERISTICS OF ELECTRON SOURCE, AND METHOD FOR MANUFACTURING ELECTRON SOURCE

BACKGROUND OF THE INVENTION

1. Field of the Invention

The present invention relates to a method and an apparatus for adjusting characteristics of an electron source equipped with many electron-emitting devices, and a method for manufacturing an electron source.

2. Related Background Art

Conventionally, two kinds of electron-emitting devices of a hot cathode device and a cold cathode device are known. As the cold cathode device of the two, for example, an electric field emission electron-emitting device (hereinafter referred to as an FE type), a metal/insulator-layer/metal electron-emitting device (hereinafter referred to as an MIM type), a surface conduction electron-emitting device (hereinafter referred to as a surface conduction emission device), and the like are known.

In an electron source in which many electron-emitting devices are wired in a passive matrix, and an electron generation apparatus and an image display apparatus to which the electron source is applied, it is desirable that the characteristics of each electron-emitting device are equal to make it possible to unify the emission luminance of each pixel.

However, because dispersion is generated in the electron-emitting characteristics of each emission device constituting the electron source to a certain extent owing to variations of processes of manufacturing, the dispersion of the characteristics appears as the dispersion of the luminance of each pixel if a display apparatus is made by the use of the emission devices. As a measure to the dispersion, a method for making the characteristics uniform by the use of the memorization property of the electron-emitting characteristic of the electron-emitting device is known (Japanese Patent Application Laid-Open No. 10-228867 and No. 2000-243256, U.S. Pat. No. 6,231,412 and EP No. 0,803,892).

If the equalization process is incorporated into the manufacturing process of an electron source, there is the possibility of the generation of the dispersion of the adjustment state of the drive of each device or the possibility of the generation of the dispersion of the adjustment state of the drive of each electron source panel. Consequently, the establishment of a more versatile equalization process capable of coping with such adjustment dispersion, also, is desired. That is, it is preferable to be able to provide a manufacturing process capable of manufacturing similar electron sources having high equality for a similar manufacturing process time even if the memorization properties of the electron-emitting characteristics of electron-emitting devices constituting an electron source differ from each other in some degree, or if the memorization properties differ from each of a plurality of electron sources in some degree.

For example, each device has a characteristic (a characteristic change curve) of an electron-emitting device peculiar to each device as shown in FIG. 14. Consequently, on the basis of the relation between emission currents Ie peculiar to each device and adjustment voltages Vshift, the most suitable adjustment voltage for obtaining a target emission current Ie1 has conventionally been selected to apply the selected voltage on a device to be adjusted.

Consequently, if the characteristic of each device is quite different from each other, it is necessary to apply a characteristic change curve of an electron-emitting device to each of the devices, and to prepare voltage values for the number of devices.

Consequently, the adjustment method becomes complicated. And if an adjustment apparatus is made in accordance with the adjustment method, the apparatus becomes complicated in structure and high in cost. And further, in a manufacturing method of an electron source incorporating the adjustment method as a part of the processes thereof, the adjustment method is a primary factor of making the management of manufacturing processes complicated.

SUMMARY OF THE INVENTION

An object of the present invention is to provide a method and an apparatus for adjusting characteristics, and a method for manufacturing an electron source, the methods and the apparatus making the characteristics of a multi-electron source to be almost the same in a simple process by the use of properties peculiar to an electron-emitting device.

According to the findings of the present inventors, it was discovered that a change rate of an electron emission current when a characteristic shifting voltage pulse was applied was almost proportional to the number of pulses, or a logarithm of a voltage application time, if the voltage was constant. And it was ascertained that the adjustment of the characteristics of devices could be performed by applying the same characteristic change curve of an electron emission current to devices having different initial electron emission currents in some degree by the use of the above-mentioned characteristic.

The gist of the present invention is to provide a method or an apparatus for adjusting characteristics of an electron source having a plurality of electron-emitting devices, and a method for manufacturing the electron source, the method for adjusting the characteristics including the step of:

applying a pulse of a voltage for adjustment to an electron-emitting device to be adjusted one or more times according to a characteristic of the electron-emitting device;

wherein:

the voltage for adjustment is selected from a plurality of voltages having discrete values according to the characteristic of the electron-emitting device; and a number of applying times of the pulse is determined according to the characteristic of the electron-emitting device and the selected voltage.

DESCRIPTION OF THE PREFERRED EMBODIMENTS

Figure 1A:
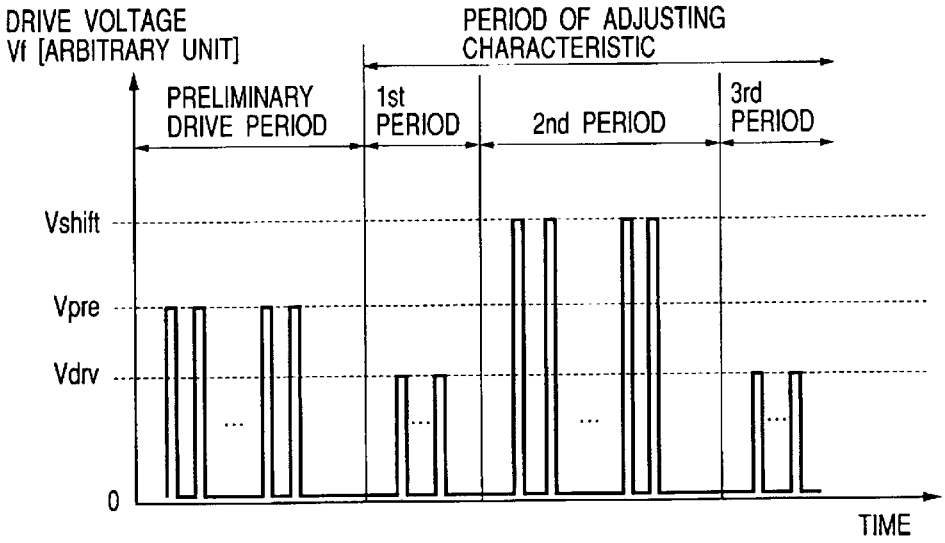
FIGS. 1A and 1B are graphs showing an example of a characteristic adjustment signal of an electron-emitting device according to an embodiment of the present invention.

An embodiment of the present invention is a method for adjusting characteristics wherein the number of applying times of a pulse of a characteristic adjustment voltage selected from a plurality of characteristic adjustment voltages selected discretely is determined according to a characteristic of an electron-emitting device and the selected characteristic adjustment voltage.

In other words, in the case where a target value of a certain characteristic is determined, the characteristics of a plurality of devices having different characteristics to some extent are brought close to the target value by making the applying times of a pulse appropriate to every device by the use of a characteristic adjustment voltage.

It is preferable to perform preliminary drive processing, which will be described later, before the process of characteristic adjustment in the present invention.

Moreover, the preliminary driving processing and the characteristic adjustment process can be executed in the sate of an electron source or in the state of having manufactured a vacuum chamber to be a display panel, and it is preferable to execute the processing and the process in a vacuum ambient atmosphere in which the partial pressure of an organic gas is $10^{-6}$ Pa or less.

Moreover, a characteristic adjustment table to be used in the present invention is preferably made on the basis of the dependency of the change rate of an electron emission characteristic on the number of applying times of the pulses of a plurality of voltages, which have discrete values, for characteristic adjustment. The change rate has been measured when the pulses are repeatedly applied to the electron-emitting device.

Then, the electron-emitting device to be used for the making of the characteristic adjustment table may be a device in an electron source to be adjusted or a device having been manufactured through the same processes.

In the present invention, it is preferable to measure an emitted current from a device, a current flowing in the device, or the brightness of a luminous element (e.g. a phosphor) emitting light by an electron emitted from the device in case of measuring the electron-emitting characteristic of the device.

Moreover, according to the present invention, because the same voltage for adjustment is used for a plurality of devices having different characteristics to some extent, it is possible to adjust the characteristics of the devices at the same time to improve the throughput of the adjustment processing.

As for an electron-emitting device to be used in the present invention, it is more preferable to use an electron-emitting device such as is disclosed in the specification and the attached drawings of U.S. Pat. No. 6,231,412.

Moreover, the present invention is suitably applied to an electron-emitting device having crystalline carbon in the electron-emitting region thereof.

In the following, embodiments of the present invention are described. However, the scope of the invention is not limited to the embodiments, the scope of the invention includes substitutes and equivalents of the constituent elements of the invention within a range capable of achieving the objects of the invention.

[Embodiment 1]

The present embodiment includes the process of preliminary drive processing capable of decreasing changes with the passage of time prior to the process of characteristic adjustment in its manufacturing process.

(Preliminary Drive Processing Process)

In case of a surface conduction electron-emitting device, for forming an electron-emitting region, the energization forming operation thereof is performed and carbon or a carbon compound is deposited at a part in the vicinity of the electron-emitting region by the energization activation operation thereof as the occasion demands. Moreover, it is preferable to execute a stabilization process after the completion of the energization activation operation. The process is one for removing organic materials in a vacuum chamber by exhausting them. It is preferable to use a vacuum pumping apparatus for exhausting the vacuum chamber that does not use any oil in order that organic materials such as oil to be generated from the apparatus may not influence the characteristics of the device. To put it concretely, vacuum pumping apparatus such as a magnetic levitation turbo molecular pump, a cryopump, an adsorption pump and ion pump can be cited. The partial pressure of organic constituents in the vacuum chamber is preferably a partial pressure of $1\times10^{-6}$ Pa or less, at which the carbon and the carbon compound are almost not deposited newly, and more preferably the partial pressure is $1\times10^{-6}$ Pa or less. Moreover, it is preferable to heat the whole of the vacuum chamber for making it easy to exhaust the molecules of organic materials adsorbed on the inner wall of the vacuum chamber and electron-emitting devices when the inside of the vacuum chamber is exhausted. An energization operation performed first in the atmosphere in which the partial pressure of the organic material in the vacuum atmosphere is decreased by such a stabilization process is the preliminary drive processing.

The electric field strength of regions in the vicinity of the electron-emitting region during being driven is extremely high. Consequently, if an electron-emitting device is driven by the same drive voltage for a long time, the amount of emission electrons is gradually decreased. The phenomenon can be considered that changes, caused by the high electric field strength, of the regions in the vicinity of the electron-emitting region with the passage of time appears as the decrease of the amount of the emitted electrons.

The preliminary drive means to measure the electric field strength of the regions in the vicinity of the electron-emitting region of a device having received the stabilization process at the time of the drive of the device at a voltage having the value of Vpre after the drive of the device for a while at the voltage Vpre. After that, an ordinary drive of the device by a drive voltage Vdrv at which the electric field strength becomes small is performed. It can be considered that the electron-emitting region of a device is previously driven by a large electric field strength by means of the drive of the application of the voltage Vpre to reveal the changes of a structural component being a cause of the instability of a characteristic with time intensively in a short period of time and thereby it becomes possible to decrease a primary factor of changes owing to the drive by the ordinary voltage Vdrv for a long term.

(Characteristic Adjustment Process)

Next, a description is given to a method for adjusting the characteristic of an electron-emitting characteristic of a device, to which a preliminary drive has been performed, by the use of the memory function of the electron-emitting characteristic. By the characteristic adjustment, the amount of electrons to be emitted at the time of the drive of the device at the voltage Vdrv decreases in comparison of that before the characteristic adjustment.

Figure 1B:
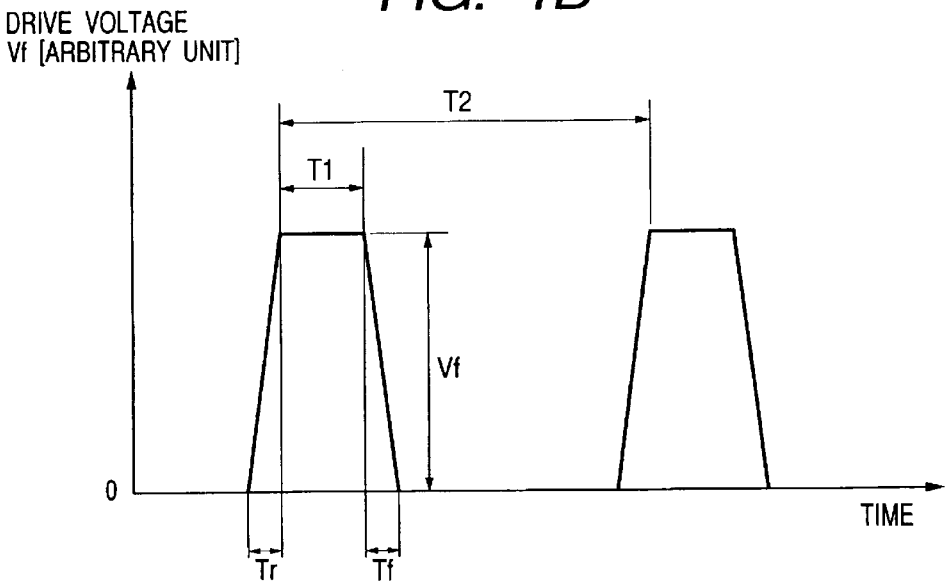

FIGS. 1A and 1B are graphs showing voltage waveforms of a preliminary drive signal and a characteristic adjustment signal applied to an electron-emitting device by paying attention to the device constituting a multi-electron source. Their abscissa axes indicate time and their ordinate axes indicate voltages applied to the electron-emitting device (hereinafter, referred to as a device voltage Vf).

Hereupon, continuous rectangular voltage pulses as shown in FIG. 1A were used as the drive signal. A period of applying the voltage pulses in a period of adjusting the characteristic was divided into three periods from a first period to a third period. In each period, the pulses were applied to the device an adequate number of times selected from one to one thousand. The peak values of the pulses and the number of the pulses that are applied to devices are determined according to the devices. Parts of the waveforms of the voltage pulses shown in FIG. 1A are shown in FIG. 1B in enlarged forms.

As concrete operation conditions, the pulse width T1 of the drive signal is set to be one millisecond, and the pulse period T2 thereof is set to be ten millisecond. Incidentally, in the drive of the device, the impedances of wiring paths from a drive signal source to the electron-emitting device were sufficiently decreased in order that the rise time Tr and the fall time Tf of the voltage pulse to be applied to the electron-emitting device effectively might be in a range of one hundred nanoseconds or shorter.

Hereupon, the device voltage Vf was set as follows: Vf=Vpre (preliminary drive voltage) in the preliminary drive period, Vf=Vdrv (display drive voltage) in the first period and the third period in the period of adjusting the characteristic, and Vf Vshift (characteristic adjustment voltage) in the second period in the period of adjusting the characteristic. These device voltages Vpre, Vdrv and Vshift were all set to be larger than the threshold voltage of the electron emission of the electron-emitting device and to satisfy the condition of $Vdrv<Vpre\leqq Vshift$. Incidentally, because the threshold voltage changes according to the shape and the material of the electron-emitting device, the device voltages were appropriately set in accordance with the electron-emitting device to be an object of the measurement.

The details of each period of the period of adjusting the characteristic in FIG. 1A are described.

(First Period: Characteristic Evaluation Period in Operation Voltage)

The first period is a period for evaluating the device characteristic at the time of decreasing the drive voltage to the ordinary drive voltage Vdrv being an operation voltage at a normal time after the application of the preliminary drive voltage. The pulses of the ordinary drive voltage Vdrv were applied to the device to measure emission currents Ie at the time of the application of the drive voltage Vdrv. The number of application times of the waveform pulse for measuring the device characteristic can be set to be, for example, one to ten times.

(Second Period: Characteristic Shift Voltage Application Period)

In the second period, for the characteristic adjustment method of the electron emission characteristic, the voltage value Vshift larger than the preliminary drive voltage Vpre is applied by the use of the memory function of the electron emission characteristic to shift the electron emission characteristic of the device. Consequently, the second and the third periods are not applied to a device the characteristic of which is unnecessary for being adjusted. In the second period, the number of the application times of the waveform pulse for shifting the electron-emitting characteristic of a device can be set to be in a range, for example, from one to one thousand in the second period.

(Third Period: Characteristic Evaluation Perios in Operation Voltage After Application of Characteristic Shift Voltage)

The third period is a period for evaluating the device characteristic at the time of decreasing the drive voltage to a display drive voltage Vdrv being an operation voltage for display at a normal time after the application of the characteristic shift voltage. As in the first period, the pulses of the device drive voltage Vdrv were applied to the device to measure emission currents Ie at the time of the application of the drive voltage Vdrv.

After each drive described above was performed to a device in such a way, similar process was performed to all of the devices. Thereby, the characteristic adjustment process to the multi-electron source was completed.

Figure 2:
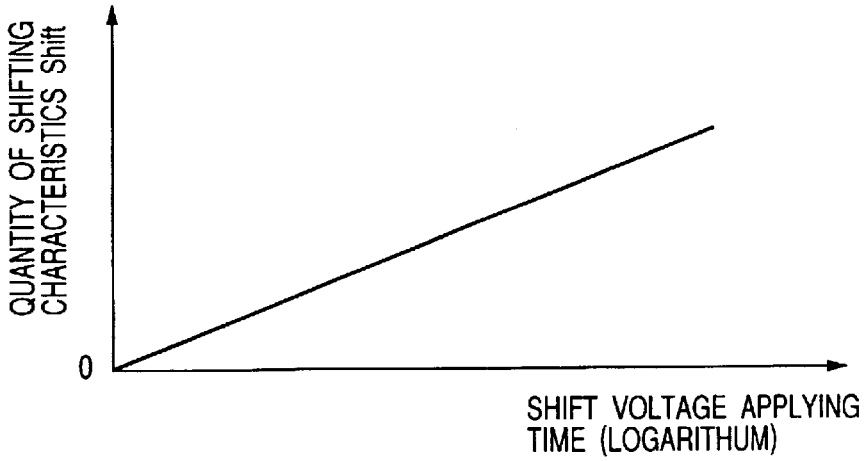
FIG. 2 is a graph showing an relation between shift voltage applying times and quantities of shifting characteristics.

Hereupon, FIG. 2 is referred while a correlation between the application time of a shift voltage, which is applied at the time of characteristic adjustment, and the quantity of shifting characteristics is described. FIG. 2 is a graph showing a correlation between the quantities of shifting characteristics Shift and shift voltage applying times at the time when a certain characteristic shift voltage Vshift having a value larger than an electron-emitting threshold value is applied. The shift voltage applying times are set on the abscissa axis of the graph by their logarithms, and the quantities of shifting characteristics Shift are set on the ordinate axis of the graph. As shown in FIG. 2, the quantities of shifting characteristics Shift increase almost in proportion to the logarithms of the shift voltage applying times.

Figure 3A:
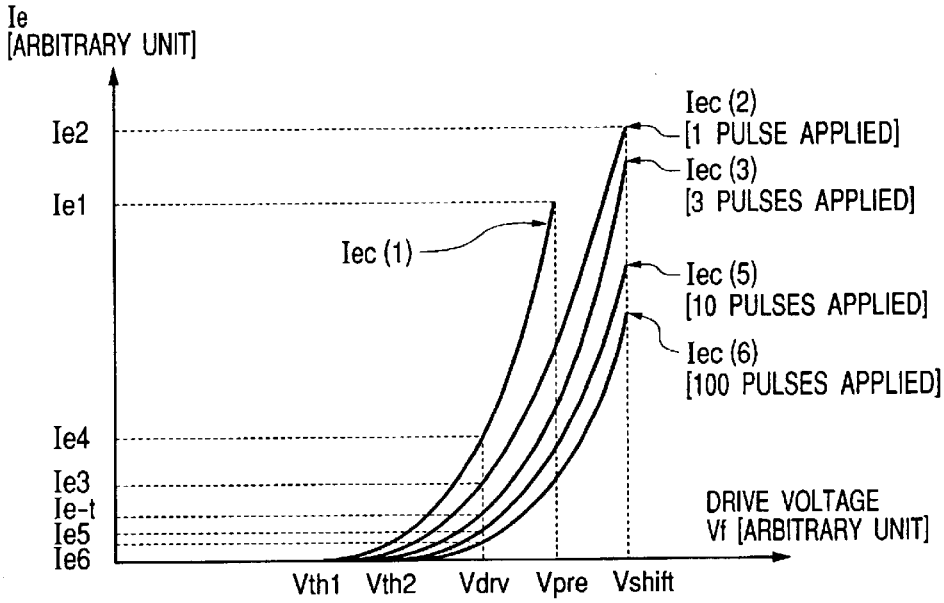
FIGS. 3A and 3B are graphs illustrating differences of emission current characteristics to drive voltages of electron-emitting devices.

FIG. 3A is a graph viewed from another aspect of the relation of FIG. 2, and shows the shifting of the emission current characteristic to the right side in accordance with the increase of the number of application pulses of the voltage Vf=Vshift. The characteristic of a device showing an emission current curve Iec(1) before the application of the pulse changes to a state indicated by an emission current curve Iec(2) that indicates a state after the application of a pulse of the voltage Vshift. After the application of three pulses of the voltage Vshift, the curve of the characteristic of the emission current becomes an emission current curve Iec(3). After the application of ten pulses of the voltage Vshift, the curve of the characteristic of the emission current becomes an emission current curve Iec(5). After the application of one hundred pluses of the voltage Vshift, the curve of the characteristic of the emission current becomes an emission current curve Iec(6). The emission current on the emission current curve Iec(5) at the time of the application of the characteristic shift pulses is an emission current Ie5 at the drive voltage Vdr, and the emission current on the emission current curve Iec(6) is an emission current Ie6 at the drive voltage Vdrv. By the use of the characteristic changes, an electron emission current at the drive voltage Vdrv in the third period can be set to be a specific value by changing the emission current characteristic to a desired emission current characteristic curve by increasing or decreasing the number of the pulses of the voltage Vshift to be applied to the device in the second period.

From FIG. 3A, it is known that the electron emission current of a certain device in a multi-electron source, which was Ie4 at the time of the application of the device voltage Vf=Vdrv, changes to Ie3→Ie5→Ie6 at the time of the application of the device voltage Vf=Vdrv by increasing the number of the application times of the shift voltage Vshift.

Figure 3B:
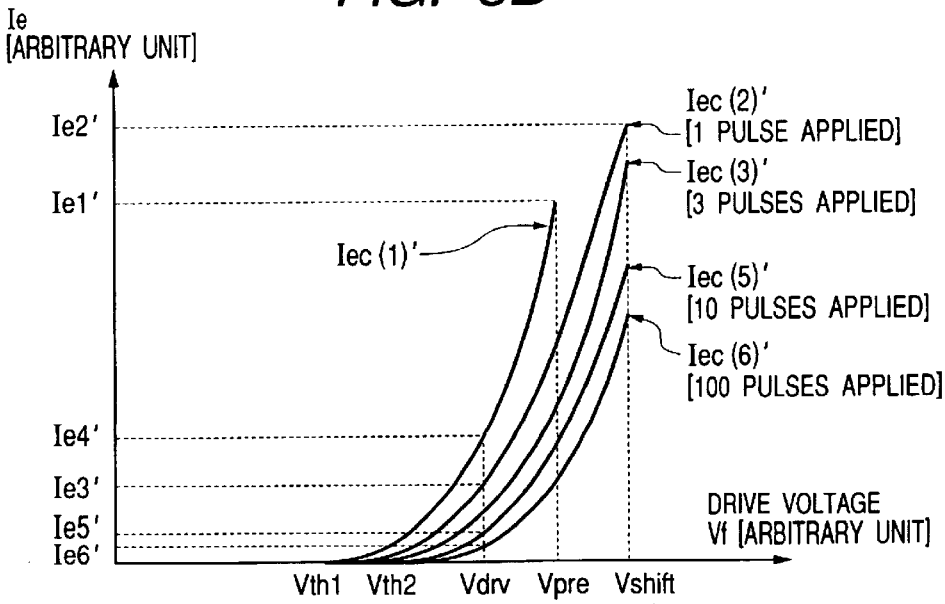

A multi-electron source is composed of many devices having different characteristics from each other after the application of the preliminary drive voltage. According to the findings of the present inventor, it was known that, in the case where a characteristic shift voltage was applied to devices having different electron-emitting characteristics from each other after the application of the preliminary drive voltage, the change rates of the characteristics were almost constant independently of the amount of electron emission, large or small, before the application of the characteristic shift voltage. That is, it is supposed that, as shown in FIG. 3B, the electron emission current, which had been Ie4' at the time of the application of the device voltage Vf=Vdrv, of a device (1) having an initial characteristic different from one shown in FIG. 3A changed to Ie3'→Ie5'→Ie6' at the time of the application of the device voltage Vf=Vdrv by increasing the number of the application times of the shift voltage Vshift after the preliminary drive. In this case, if the change rate of the emission current Ie shown in FIGS. 3A and 3B is noticed, when the shift voltage Vshift is applied to a device (1) showing the emission current curve Iec(1) of FIG. 3A, the emission current Ie changes as follows: Ie4 (intial)→Ie3 (three pulses)→Ie5 (ten pulses)→Ie6 (one hundred pulses). The change rates of the emission current Ie change as follows: Ie3/Ie4→Ie5/Ie4→Ie6/Ie4. When the shift voltage Vshift is applied to a device (2) showing the emission current curve Iec(1)' of FIG. 3B, the emission current Ie and the change rates change as follows. As for the emission current Ie, Ie4' (intial) Ie3' (three pulses)→Ie5' (ten pulses) →Ie6' (one hundred pulses). As for the change rates, Ie3'/Ie4'→Ie5'/Ie4'→Ie6'/Ie4'. Now, by comparing each of the change rates of Ie3/Ie4, Ie5/Ie4 and Ie6/Ie4 with Ie3'/Ie4', Ie5'/Ie4' and Ie6'/Ie4', respectively, it was known that each of them were almost the same, respectively. By using the characteristic, even in the case where the initial emission currents of devices differ from each other to some extent, the adjustments of the characteristics of the devices can be performed by applying the same change curves of the emission current characteristics.

Accordingly, in the present embodiment, by the use of a part of devices of a multi-electron source, change curves of emission current characteristics of the devices to the application of characteristic shift voltages are first obtained. Then, the adjustment of the characteristics of the whole of the multi-electron source on the basis of the obtained change curves. Although the details of the processing will be described later, the adjustment is performed by obtaining data not by using continuous voltage values but by using a plurality of discrete voltage values as shift voltage values to be applied, and the characteristics of the whole of the electron source are adjusted within a desired time.

Hereupon, an apparatus for adjusting characteristics according to an embodiment of the present invention is described in detail.

Figure 4:
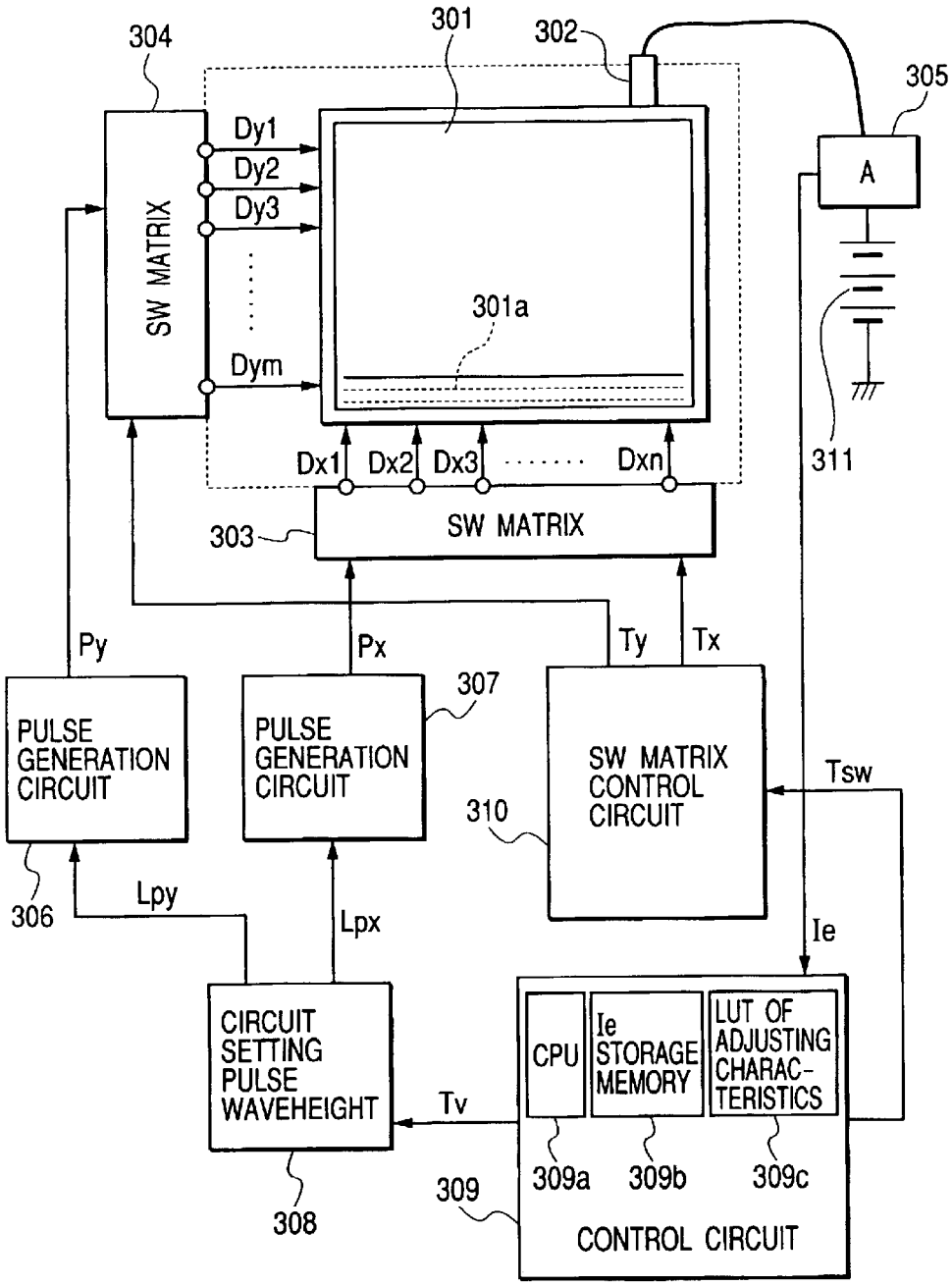
FIG. 4 is a schematic block diagram of an apparatus for adjusting characteristics of a multi-electron source according to an embodiment 1 of the present invention.

FIG. 4 is a block diagram showing the configuration of an apparatus for adjusting characteristics including a drive control circuit for changing the electron-emitting characteristic of each of electron-emitting devices constituting a display panel 301 using a multi-electron source by applying a waveform signal for adjusting the characteristic of each of the electron-emitting devices.

In FIG. 4, the reference numeral 301 designates the display panel. In the present embodiment, it is supposed that a plurality of electron-emitting devices is wired in a passive matrix on the display panel 301 and the forming operation and the activation operation of the electron-emitting devices have been completed and they are in their stabilization process. The display panel 301 is a vacuum chamber including a substrate on which the plurality of the electron-emitting devices are disposed in a matrix, a face plate which is disposed above the substrate in a separate state from the substrate and has a phosphor emitting light by electrons emitted from the electron-emitting devices, and the like. These electron-emitting devices are connected with electric circuits on the outside through row-directional wiring terminals Dx1 to Dxn and column-directional wiring terminals Dy1 to Dym. A reference numeral 301*a* designates a part of many electron-emitting devices constituting the display panel 301. The part 301*a* of the electron-emitting devices is used for devices for obtaining data for characteristic adjustment.

A reference numeral 302 designates a terminal for applying a high voltage from a high voltage source 311 to the phosphor of the display panel 301. Reference numerals 303 and 304 designate switch matrices as drive circuits that select the row-directional wiring and the column-directional wiring, respectively, to select an electron-emitting device to which pulse voltages are applied. Reference numerals 306 and 307 designate pulse generation circuits for generating pulse waveform signals Py and Px, respectively. A reference numeral 308 designates a circuit setting pulse wave heights. The circuit 308 determines the wave height values of pulse signals output from the pulse generation circuits 306 and 307 by outputting pulse setting signals Lpy and Lpx, respectively. A reference numeral 309 designates a control circuit. The control circuit 309 controls the whole of the flow of characteristic adjustment. The control circuit 309 outputs data Tv for setting wave height values in the circuit setting pulse wave height 308, and controls the number of application times of pulses. Incidentally, a reference numeral 309*a* designates a central processing unit (CPU). The CPU 309*a* controls the operations of the control circuit 309. The operations of the CPU 309*a* will be described by reference to the flowcharts of FIGS. 5, 6 and 9.

In FIG. 4, a reference numeral 309*b* designates a memory for storing the characteristics of each device for the characteristic adjustment of each device. To put it concretely, the memory 309*b* stores the electron-emitting current Ie of each device at the time of the application of the drive voltage Vdrv. A reference numeral 309*c* designates a look-up table for reference (an LUT for characteristic adjustment), the details of which will be described later, made by obtaining data by applying a voltage to the part 301*a* of the devices.

The look-up table 309*a* is referred at the time of the adjustment of characteristics. A reference numeral 310 designates a switch matrix control circuit. The switch matrix control circuit 310 selects an electron-emitting device to which pulse voltages are applied by controlling the selection of the switch matrices 303 and 304 by outputting switch switching signals Tx and Ty, respectively.

Next, the data obtainment that is necessary for a characteristic adjustment process is described. In the present embodiment, the electron emission current Ie from each device is measured and stored for the adjustment of the electron emission current of a device.

The details of the measurement of the electron emission current Ie is described. It is necessary to measure at least the electron emission current Ie flowing at the time of the application of the drive voltage Vdrv for the adjustment of characteristics. Then, the measurement of the electron emission current Ie at the time of the application of the drive voltage Idrv is described. The switch matrix control circuit 310 controls the switch matrices 303 and 304 to be switched and connected in order to select predetermined row-directional wiring and column-directional wiring, respectively, for driving a desired electron-emitting device by means of a switch matrix control signal Tsw from the control circuit 309.

On the other hand, the control circuit 309 outputs wave height data Tv corresponding to the drive voltage Vdrv to the circuit setting pulse wave height 308. Thereby, the circuit setting pulse wave height 308 outputs the wave height value data Lpy and Lpx to the pulse generation circuit 306 and 307, respectively. On the basis of the wave height value data Lpy and Lpx, the pulse generation circuit 306 and 307 respectively output the drive pulses Py and Px. The drive pulses Px and Py are applied to the device selected by the switch matrices 303 and 304. Hereupon, the drive pulses Px and Py are set to be pulses having an amplitude of a half of the drive voltage Vdrv (wave height) and polarities different from each other. Moreover, at the same time, a predetermined voltage is applied to the phosphor of the display panel 301 by the high voltage source 311.

The electron emission characteristic of an electron-emitting device is one in which the electron emission current Ie rapidly increases when a device voltage equal to a certain voltage (called as a threshold value such as a voltage Vthl in FIG. 3A) or more is applied and, on the other hand, the electron emission current Ie can hardly be detected at the threshold voltage or less. That is, the electron-emitting device is a nonlinear device having a definite threshold value voltage Vth to the electron emission current Ie. Consequently, in the case where the drive pulses Px and Py are pulses having the amplitude values of a half of the drive voltage Vdrv and polarities different from each other, only the device selected by the switch matrices 303 and 304 performs electron emission. Then, the electron emission current Ie at the time when the electron-emitting device is driven by the drive pulses Px and Py is measured with a current detector 305.

Figure 5:
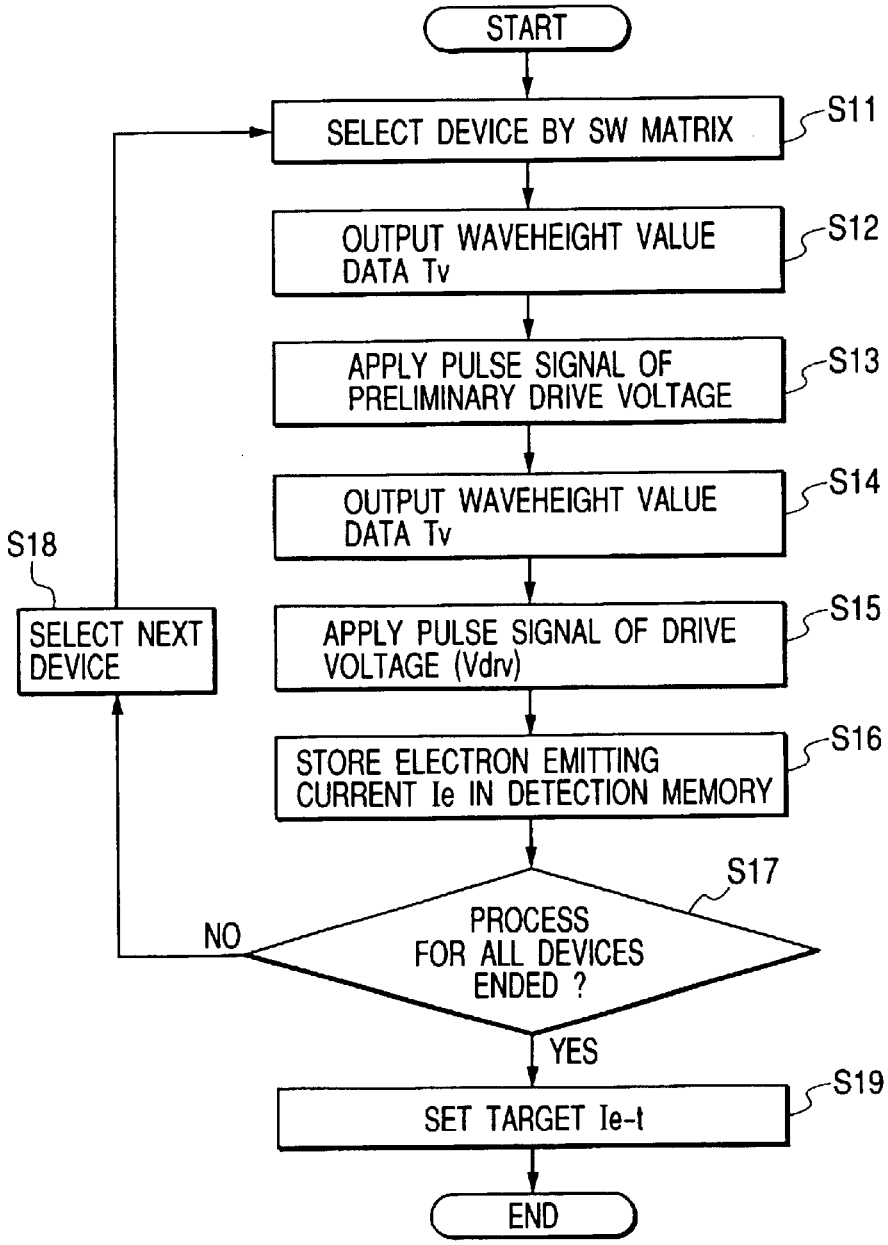
FIG. 5 is a flow chart of characteristic adjustment of the apparatus of FIGS. 1A and 1B.
Figure 6:
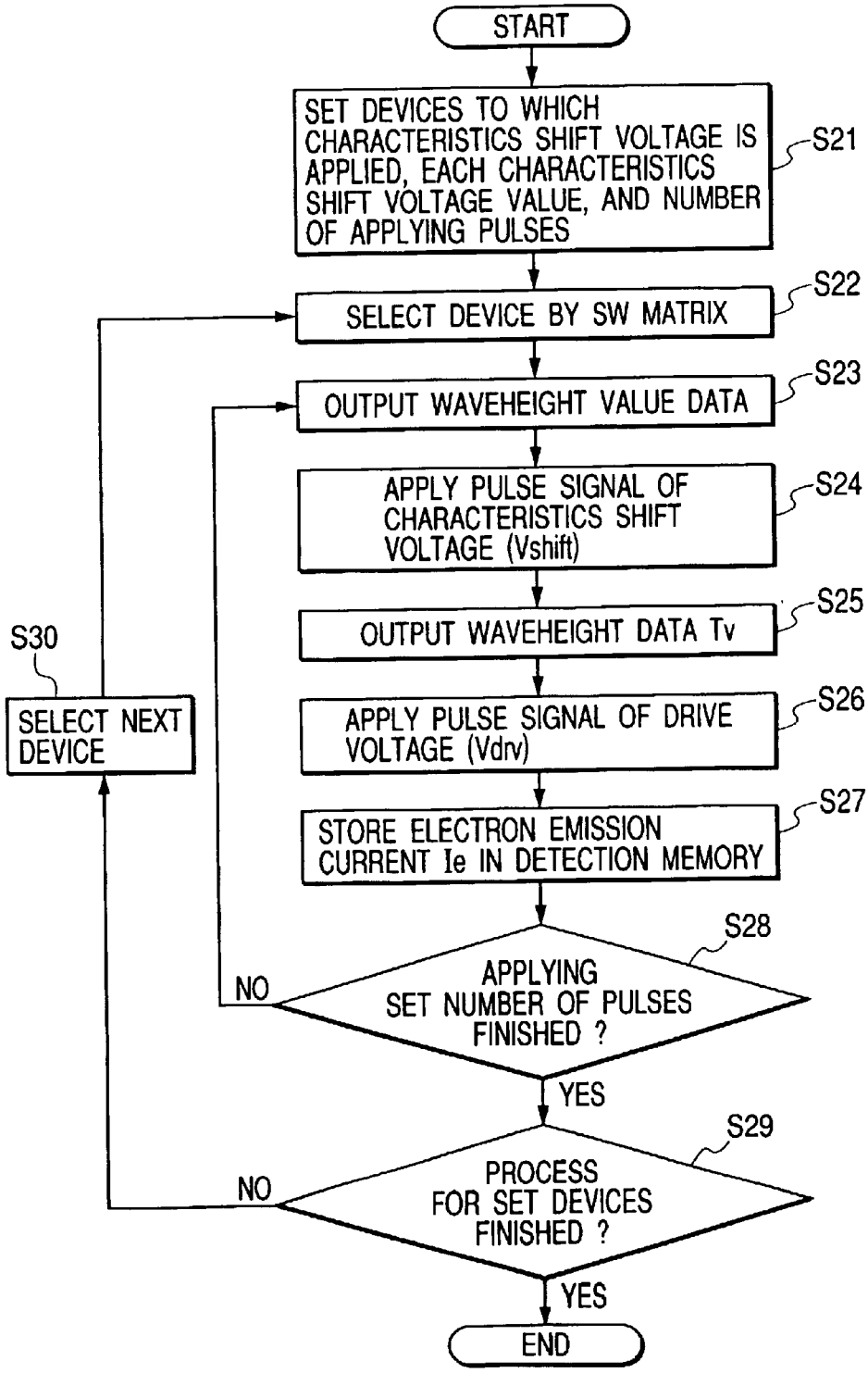
FIG. 6 is a flow chart following the flow of FIG. 5.
Figure 9:
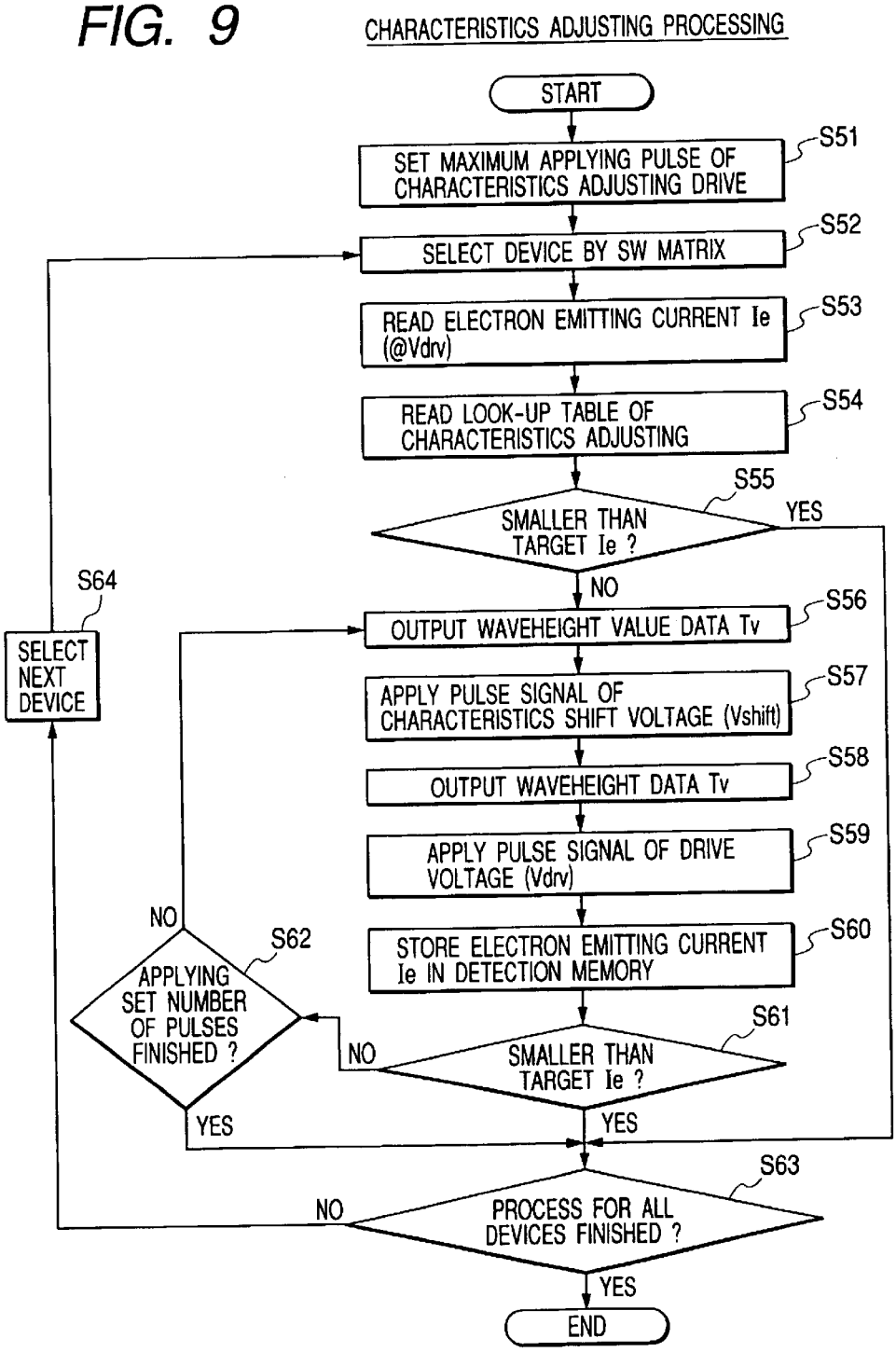
FIG. 9 is a flow chart following the flow of FIG. 6.

In the following, the flowcharts shown in FIGS. 5, 6 and 9 are used for describing a method for adjusting characteristics using the apparatus for adjusting characteristics of FIG. 4. Because, in the present embodiment, preliminary drive and characteristic adjustment drive ware performed, both of the drive processes are described together.

The process flow is composed of the step of setting a reference target electron emission current value Ie-t at the time of performing characteristic adjustment by measuring the electron emission characteristics at the time of the application of the drive voltage Vdrv after the application of the preliminary drive voltage Vpre to all of the electron-emitting devices of the display panel 301 (corresponding to the flowchart of FIG. 5 and the preliminary drive period and the first period of the period of adjusting characteristics in FIG. 1A), the step of forming a look-up table by introducing the change rate of the electron emission current at the time of the alternative application of the characteristic shift voltage Vshift and the ordinary drive voltage Vdrv to the device by the use of the part 301*a* of the devices at the place where almost no trouble is brought about to display images (corresponding to the flowchart of FIG. 6, and the second and the third periods of the period of adjusting characteristics in FIG. 1A), and the step of applying a pulse waveform signal of the characteristic shift voltage Vshift according to the look-up table for characteristic adjustment and of measuring the electron emission characteristics by applying the drive voltage Vdrv for judging the completion of the characteristic adjustment (corresponding to the flowchart of FIG. 9, and the second and the third periods of the period of adjusting characteristics of FIG. 1A).

A description is first given to the step of setting the reference target electron emission current value Ie–t at the time of performing characteristic adjustment by measuring the electron emission characteristics at the time of the application of the ordinary drive voltage Vdrv after the application of the preliminary drive voltage Vpre to all of the electron-emitting devices of the display panel 301 (corresponding to the flowchart of FIG. 5 and the preliminary drive period and the first period in the period of adjusting characteristics FIG. 1A).

At a step S11, the control circuit 309 outputs the switch matrix control signal Tsw to the switch matrix control circuit 310, and the switch matrix control circuit 310 switches the switch matrices 303 and 304 to select an electron-emitting device in the display panel 301. Next, at a step S12, the control circuit 309 outputs the wave height data Tv of the pulse signal to be applied to the selected device to the circuit setting pulse wave height values 308. The pulse wave height value for measurement is the preliminary drive voltage value Vpre (=16V). Then, at a step S13, the pulse generation circuits 306 and 307 apply the pulse signals of the preliminary drive voltage Vpre to the electron-emitting device that has been selected at the step S11 through the switch matrices 303 and 304.

At a step S14, for performing the evaluation of the electron emission characteristic of the device, which was driven at the preliminary drive voltage Vpre, at the time when the device is driven by a voltage decreased to the drive voltage value Vdr, the drive voltage value Vdrv is set to be 14.5 V as the wave height value data Tv of the pulse signals to be applied to the selected device. Then, at a step S15, the pulse signals of the drive voltage Vdrv are applied to the electron-emitting device selected at the step S11. At a step S16, the electron emission current Ie at the drive voltage Vdrv is store in the memory 309*b* for characteristic adjustment.

At a step S17, it is examined whether all of the electron-emitting devices in the display panel 301 has been measured. If not, the process flow advances to a step S18 to set the switch matrix control signal Tsw for selecting the next electron-emitting device, and then the process flow advances to the step S11.

On the contrary, if the measurement processing to all of the electron-emitting devices has been completed at the step S17, at a step S19, the electron emission current Ie at the drive voltage Vdrv is compared to all of the electron-emitting devices in the display panel 301 to set the reference target electron emission current value Ie−t.

The reference target electron emission current value Ie−t was set as follows.

As shown in FIG. 3A, by the application of the characteristic shift voltage, the Ie−Vf curve of any of the devices shifts to the right side. Consequently, the target is set to be small one of the emission currents Ie at the time of the application of the drive voltage Vdrv. However, when the target value is set to be too small, the average electron emission amount of the multi-electron source after the adjustment of characteristics decreases greatly. In the present embodiment, the electron emission current values of all of the devices were statistically processed to calculate the average electron emission current Ie−ave of the electron emission current values and a standard deviation σ−Ie. Then, the reference target electron emission current value Ie−t was set to be:

$$Ie-t=Ie-ave-\sigma-Ie.$$

By the setting of the reference target electron emission current value Ie−t like this, it is possible to decrease the dispersion of electron emission amounts of respective devices without decreasing the average electron emission current of the multi-electron source after characteristic adjustment largely.

Next, a description is given to the procedure of measuring the electron emission current Ie of a plurality of electron-emitting devices in the part 301*a* of the devices at the place where almost no trouble is brought about to display images in the display panel 301 at the time when one to one hundred pulses of a plurality of characteristic shift voltage are applied to the plural electron-emitting devices, and the step of making a look-up table for performing the character adjustment on the basis of the measured data (corresponding to the flowchart of FIG. 6, and the second and the third periods of the period of adjusting characteristics in FIG. 1A).

At the time of making the look-up table, four steps of discrete voltage values (Vhsift1 to Vshift4) were selected as the characteristic shift voltages, and the characteristic shift amounts were measured to every voltage. The ranges of the characteristic shift voltages Vshift are, as described above: Vshift≧Vpre. The ranges of the shift voltages Vshift are set appropriately according to the shapes and the materials of the electron-emitting devices. Ordinarily, the shift voltages Vshift are set by being divided to be several steps within a range of about 1 V, and thereby the characteristic adjustment can be performed.

First, a description is given to the procedure for measuring the change quantity of the electron-emission current Ie at the time of the application of one to one hundred pulses of each of four characteristic shift voltages Vshift1, Vshift2, Vshift3 and Vshift4 to four electron-emitting devices being samples in the flowchart of FIG. 6.

The devices being samples may be prepared to be plural to each of the characteristic shift voltages and the average values and the medians of them may be used.

At a step S21, the region at which the four characteristic shift voltages are respectively applied to four or more electron-emitting devices, the number of the devices, each characteristic shift voltage value, and the number of applying pulses are set. In this case, the part 301*a* of the devices at the place where almost no trouble is brought about to display images was selected as the region in the display panel 301 where each of the four characteristic shift voltages is applied to the plurality of electron-emitting devices. The number of the devices was set to be 20 to one characteristic shift voltage. At a step S22, the switch matrix control signal Tsw is output. Then, the switch matrix control circuit 310 switches the switch matrices 303 and 304 to select one electron-emitting device in the display panel 301. At a step S23, the wave height data Tv of a pulse signal to be applied to the selected device is output to the circuit setting pulse wave heights values 308. The wave height values for the characteristic shift voltages are, for example, any of the preliminary drive voltage value Vpre=16 V, the characteristic shift voltage values Vshift1=16.25 V, Vshift2=16.5 V, Vshift3=16.75 V, and Vshift4=17 V. Then, at a step S24, the pulse generation circuits 306 and 307 apply the pulses of the characteristic shift voltages Vshift as the first time of the characteristic shift voltages to the electron-emitting device selected at the step S21 through the switch matrices 303 and 304.

At a step S25, for performing the evaluation of the electron emission characteristic of the device, to which the characteristic shift voltages were applied, at the time when the device is driven by a voltage lowered to the drive voltage Vdrv, the drive voltage value Vdrv=14.5 V is set as the wave height data Tv of the pulse signal to be applied to the selected device. Then, at a step S26, the pulse signal of the drive voltage value Vdrv is applied to the electron-emitting device selected at the step S22. At a step S27, the electron emission current Ie at the drive voltage Vdrv is stored in the memory 309*b* as the change data of the electron emission amount according to the pulse number of the application of the character shift voltages. At a step S28, whether the predetermined number of times of the characteristic shift voltages was applied to the electron-emitting device selected at the step S21 or not is examined. If the characteristic shift voltages have not been applied to the device by the predetermined number of times yet, the process flow advances to the step S23. On the contrary, the number of the application times of the voltages has reached the predetermined number of application times at the step S28, the process flow advances to a step S29. At the step S29, whether the measurement of the change of the electron emission amount has been performed to a plurality of predetermined electron-emitting devices or not is examined. If the measurement has not been performed to the plurality of predetermined electron-emitting devices, the process flow advances to a step S30. At the step S30, the switch matrix control signal Tsw for the selection of the next electron-emitting device is set, and the process flow advances to the step S22. On the contrary, if the measurement processing to the predetermined electron-emitting devices has completed at the step S29, the change amounts of the emission currents of the plurality of the predetermined electron-emitting devices at the time of the application of each of the five characteristic shift voltages Vshift0 (=Vpre), Vshift1, Vshift2, Vshift3 and Vshift4 to the devices are made to a graph.

Figure 7:
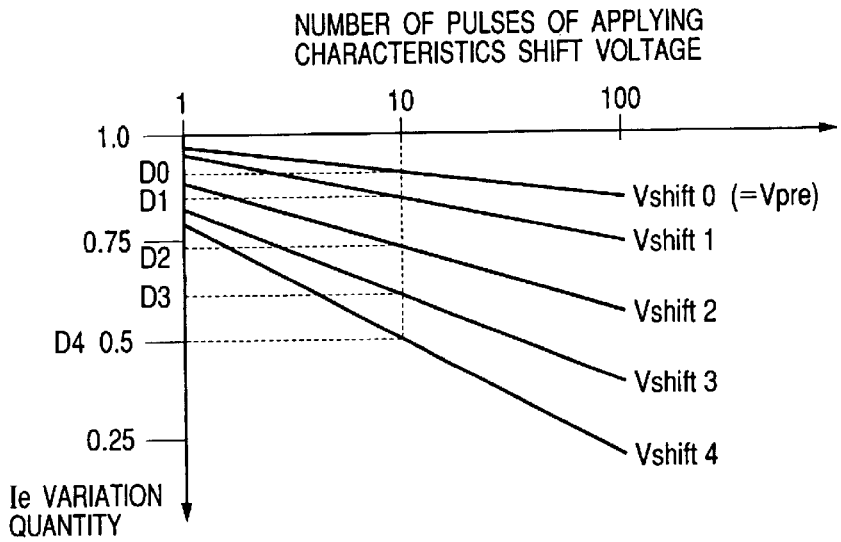
FIG. 7 is a graph of characteristic curves illustrating the variation quantities of electron emission currents when several kinds of drive voltages are continuously applied to devices at every drive voltage.

FIG. 7 is the graph made in the above-mentioned way for showing the change amounts (average values) of the emission currents of the devices. Incidentally, the emission current values of the devices in this case are values measured at the time of driving the devices by the drive voltage Vdrv at every application of a pulse of each characteristic shift voltage. The relations of the five characteristic shift voltages are as follows: Vshift4>Vshift3>Vshift2>Vshift1>Vpre.

As shown in FIG. 7, by increasing the number of the application of the characteristic shift voltage or by increasing the characteristic shift voltage, the change amount of the device characteristic becomes large, i.e. the adjustment amount becomes much. The character adjustment of the whole of the multi-electron source by the use of the characteristic change curves shown in FIG. 7 is performed by the following two steps.

(1) The range of the characteristic shift voltage and the average number of the application pulses are set on the basis of the reference target electron emission current value Ie−t set on the basis of the results of the emission current Ie of FIG. 5. That is, the procedures up to this process are the step of making a look-up table for the characteristic adjustment.

(2) The characteristic shift voltage is set to each device on the basis of the set values determined at the step (1). And, the application of the characteristic shift voltage and the measurement of the electron emission current characteristic are repeated to shift the characteristic to the target value. That is, these are the application of the pulse waveform signal of the characteristic shift voltage Vshift in accordance with the look-up table for the characteristic adjustment and the step of measuring the electron emission characteristic by applying the drive voltage Vdrv for the judgment of the completion of the characteristic adjustment (corresponding to the flowchart of FIG. 9, and the second and the third periods of the period of adjusting characteristic of FIG. 1A).

The steps (1) and (2) are described in detail.

(1) The largest current value measured in FIG. 5 is supposed to be an Iemax value, and the maximum adjustment rate Dmax is obtained in accordance with the following formula from the reference target electron emission current value Ie−t set in FIG. 5.

$$Dmax=Ie-t/Iemax$$

For example, if it is supposed that the values of the reference target electron emission current value Ie−t and the largest current value Iemax are respectively 0.9 μA and 1.2 μA, it becomes necessary that the maximum adjustment rate Dmax is 0.75. From FIG. 7, in this case, it is known that, even if the characteristic shift voltage Vshift4 is applied as the maximum shift voltage, it is impossible to adjust the whole with one pulse. On the other hand, when the number of the application pulses for characteristic shifting increases, the process time for characteristic adjustment becomes long. It is not preferable. Accordingly, in the present embodiment, the number of application pulses for characteristic shifting is set to be ten pulses on an average. In this case, the time necessary for the performance of the process can be estimated by means of the product of the application time of ten pulses and the number of the devices having an electron emission current Ie equal to or larger than the reference target electron emission current value Ie−t.

Adjustment rates D0 to D4 of the emission currents Ie at the time of the application of ten pulses are read out from FIG. 7.

In this case, the upper limit value Ie−u of the electron emission current Ie at the application of the drive voltage Vdrv immediately after the application of a pulse of the preliminary drive voltage Vpre at the first time which would reach the reference target electron emission current value Ie−t immediately after the application of ten pulses of a certain characteristic shift voltage Vshift can be expressed by the following formula.

$$Ie-u=Ie-t/D$$

That is, if ten pulses of the characteristic shift voltage Vshift are applied to a device which has the characteristic being the reference target electron emission current Ie−u and has been preliminarily driven, the electron emission current of the device is the reference target electron emission current value Ie−t.

That is, if the adjustment rate when ten pulses of the characteristic shift voltage Vshit1 are applied is supposed to be D1, the upper limit value Ie−ul of the electron emission current Ie at the time of the application of the drive voltage Vdrv after the application of one pulse of the preliminary drive voltage Vpre at this time becomes:

$$Ie-u1=1Ie-t/D1.$$

Similarly, if the adjustment rate at the time of the application of ten pulses of the characteristic shift voltage Vshift2 is supposed to D2, the upper limit value Ie−u2 of the electron emission current Ie at the time of the application of the drive voltage Vdrv after the application of one pulse of the preliminary drive voltage Vpre in this case is:

$$Ie-u2=Ie-t/D2.$$

If the adjustment rate at the time of the application of ten pulses of the characteristic shift voltage Vshift3 is supposed to D3, the upper limit value Ie−u3 of the electron emission current Ie at the time of the application of the drive voltage Vdrv after the application of one pulse of the preliminary drive voltage Vpre in this case is:

$$Ie-u3=Ie-t/D3.$$

If the adjustment rate at the time of the application of ten pulses of the characteristic shift voltage Vshift4 is supposed to D4, the upper limit value Ie−u4 of the electron emission current Ie at the time of the application of the drive voltage Vdrv after the application of one pulse of the preliminary drive voltage Vpre in this case is:

$$Ie-u4=Ie-t/D4.$$

Moreover, if the adjustment rate at the time of the application of ten pulses of the characteristic shift voltage Vshift0 (=Vpre) is supposed to DO, the upper limit value Ie−u0 of the electron emission current Ie at the time of the application of the drive voltage Vdrv after the application of one pulse of the preliminary drive voltage Vpre in this case is:

$$Ie-u0=Ie-t/D0.$$

Figure 8:
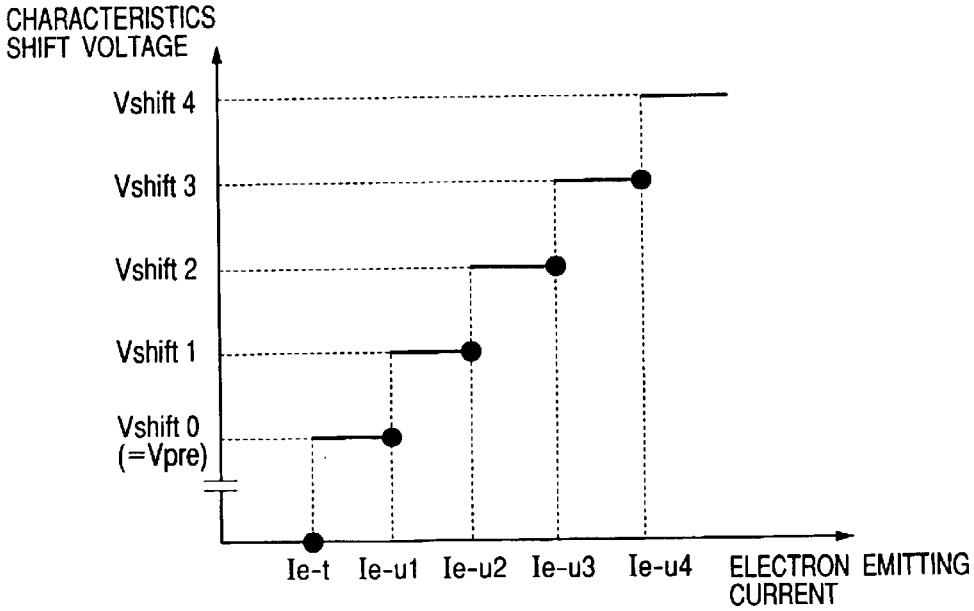
FIG. 8 is a graph showing extents of electron emission currents of respective electron-emitting devices to discrete characteristics shift voltages to be applied for the characteristic adjustment in the embodiment 1.

A look-up table for characteristic adjustment which was made on the basis of the respective upper limit values of the electron emission current Ie is FIG. 8. In FIG. 8, the region of the electron emission current Ie at the application of the drive voltage Vdrv after the application of one pulse of the preliminary drive voltage Vpre for implementing the characteristic adjustment by applying the characteristic shift voltage Vpre (=Vshift0) is a range from the reference target electron emission current value Ie−t to the upper limit value Ie−u1. Similarly, the region of the electron emission current Ie at the application of the drive voltage Vdrv after the application of one pulse of the preliminary drive voltage Vpre for implementing the characteristic adjustment by applying the characteristic shift voltage Vshiftl is a range from the upper limit value Ie−ul to the upper limit value Ie−u2. The region of the electron emission current Ie at the application of the drive voltage Vdrv after the application of one pulse of the preliminary drive voltage Vpre for implementing the characteristic adjustment by applying the characteristic shift voltage Vshift2 is a range from the upper limit value Ie−u2 to the upper limit value Ie−u3. The region of the electron emission current Ie at the application of the drive voltage Vdrv after the application of one pulse of the preliminary drive voltage Vpre for implementing the characteristic adjustment by applying the characteristic shift voltage Vshift3 is a range from the upper limit value Ie−u3 to the upper limit value Ie−u4. The region of the electron emission current Ie at the application of the drive voltage Vdrv after the application of one pulse of the preliminary drive voltage Vpre for implementing the characteristic adjustment by applying the characteristic shift voltage Vshift4 is a range larger than the upper limit value Ie−u4. If the electron emission current Ie at the time of the application of the drive voltage Vdrv after the application of the preliminary drive voltage Vpre is larger than the upper limit value Ie−u4, the characteristic shift voltage Vshift 4 is applied.

For example, if the adjustment rates D0, D1, D2, D3 and D4 at the time of the application of ten pulses of respective characteristic shift voltages are 0.9, 0.81, 0.72, 0.6 and 0.5, respectively, and if the reference target electron emission current value Ie−t is 0.9 μA, and further if the maximum value of the emission current Ie is 1.55 μA, the ranges of the emission currents Ie of the devices to which respective characteristic shift voltages are applied are 0.9<Ie≦1.0μA (@ Vshift0), 1.0<Ie≦1.11 μA (@ Vshift1), 1.11<Ie≦1.25 μA (@ Vshift2), 1.25<Ie≦1.5 μA (@ Vshift3), and 1.5<Ie (@ Vshift4).

(2) By the use of the flowchart of FIG. 9, a description is given to the application of the pulse waveform signal of the characteristic shift voltage Vshift by reference to the look-up table (FIG. 8) for the characteristic adjustment, and the step of measuring the electron emission characteristic by applying the drive voltage Vdrv for the judgment of the completion of the characteristic adjustment (corresponding to the flowchart of FIG. 9, and the second and the third periods of the period of adjusting characteristic of FIG. 1A).

First, at a step S51, the maximum number of application pulses to be applied for characteristic adjustment to a surface conduction electron-emitting device to which the characteristic adjustment is performed in the display panel 301 is set. The maximum number of the application pulses is set to be 20 pulses being twice as much as the average number of the application pulses in this case. Next at a step S52, the control circuit 309 outputs the switch matrix control signal Tsw to the switch matrix control circuit 310, and the switch matrix control circuit 310 switches the switch matrices 303 and 304 to select an electron-emitting device in the display panel 301. Next, at a step S53, the control circuit 309 reads out the electron emission current value Ie of the selected device at the time of the application of the drive voltage Vdrv after the preliminary drive of the device. At a step S54, the control circuit 309 reads out the look-up table for characteristic adjustment. At a step S55, the control circuit 309 compares the electron emission current value Ie of the selected device read out at the step S53 with the reference target electron emission current value Ie−t in the characteristic adjustment, and the control circuit 309 judges whether to perform the characteristic adjustment or not. If the electron emission current value Ie is equal to or less than the reference target electron emission current value Ie−t in the characteristic adjustment, the characteristic adjustment is not performed, and the process flow advances to a step S63. If the electron emission current value Ie is larger than the reference target electron emission current value Ie−t in the characteristic adjustment, the look-up table for characteristic adjustment read out at the step S54 is referred while any of the characteristic adjustment voltage values Vshift0 to Vshift4 corresponding to the electron emission current value Ie of the selected device is set, and thereby the wave height value data Tv of the pulse signal to be applied to the selected device are output to the circuit setting pulse wave height values 308 (a step S56). At a step S57, the pulse generation circuits 306 and 307 apply the pulse signal of any of the characteristic shift voltage values Vshift0 to Vshift4 to the electron-emitting device that has been selected at the step S52 through the switch matrices 304 and 303, respectively. For example, if the electron emission current value Ie of the device selected at the step S52 is Ie−p and the electron emission current value Ie is within the following range, the characteristic shift voltage value is Vshift2 from the look-up table for characteristic adjustment in FIG. 8.

$$Ie\text{-}u2 < Ie\text{-}p \leqq Ie\text{-}u3$$

At a step S58, for performing the evaluation of the electron emission characteristic of the device, the characteristic of which was adjusted, at the time when the device is driven by a voltage decreased to the drive voltage value Vdrv, the drive voltage value Vdrv is set as the wave height value data Tv of the pulse signal to be applied to the selected device. Then, at a step S59, the pulse voltages of the drive voltage value Vdrv are applied to the electron-emitting device selected at the step S52. At a step S60, the electron emission current Ie at the drive voltage value Vdrv is measured to be stored in the memory 309*b*. At a step S61, if the electron emission current value Ie measured at the step S60 is not equal to or less than the reference target electron emission current value Ie−t in the characteristic adjustment, the process flow advances to a step S62 for checking the accumulation number of application pulses to the maximum number of application pulses for characteristic adjustment drive. If the electron emission current value Ie measured at the step S60 is equal to or less than the reference target electron emission current value Ie−t in the characteristic adjustment, the process flow advances to a step S63 without implementing the characteristic adjustment. At the step S62, it is checked whether the accumulation number of application pulses to the selected device has reached the set value of the maximum number of application pulses for characteristic adjustment drive or not. If the accumulation number has not reached the set value, the process flow advances to the step S56. If the accumulation number has reached the set value, the process flow advances to a step S63. At the step S63, it is examined whether the characteristic adjustment of all of the electron-emitting devices in the display panel 301 has been performed or not. If not, the process flow advances to a step S64 to select the next device. And, the switch matrix control signal Tsw is output. Then, the process flow advances to the step S52. If the characteristic adjustment to all of the electron-emitting devices has been completed at the step S63, the process flow is completed. Thereby, the electron emission currents of all of the devices have been made uniform. At this point, the step (2) is terminated. In this case, the time necessary for the process is almost the product of the number of the devices having the initial electron emission current Ie larger than the reference target electron emission current value Ie−t and the time of the application of ten pulses of the shift voltage.

Moreover, although, in the present embodiment, the procedure is adopted by which the look-up tables for characteristic adjustment are made to every display panel 301 and the characteristic adjustment is performed on the basis of the look-up tables for characteristic adjustment, it is also possible to perform the characteristic adjustment as follows. That is, in the case where the characteristic adjustment is performed by setting the same reference target electron emission current value Ie−t of the electron-emitting devices in the display panel 301 in the same lot, only the look-up table for characteristic adjustment to the first display panel is made. In the display panels of the second sheet and the followings; if measurement results of electron emission characteristics at the time of the application of the drive voltage Vdrv after the application of the preliminary drive voltage Vpre to all of the electron-emitting devices in the display panel 301 are within a range capable of being set as the reference target electron emission current value Ie–t of the electron-emitting devices, the characteristic measurement can be performed by the use of the look-up table for characteristic adjustment of the first sheet display panel by obtaining the data of a part of the characteristic curves shown in FIG. 7 only for ascertaining without obtaining all of the characteristic curves. Thereby, the processing time of the characteristic adjustment of the second sheet and the followings of the display panels can be curtailed.

[Embodiment 2]

In the first embodiment, the procedure for performing the individual characteristic adjustment to every device of the electron-emitting devices in the display panel 301 has been described. On the contrary, in the present embodiment, the time spent for characteristic adjustment is not so much increased even in the case where the structure of the electron-emitting devices in the display panel 301 take a high density and the number of all of the electron-emitting devices is remarkably increased.

To put it concretely, the procedure of performing the characteristic adjustment of one device or a plurality of devices of the devices in the display panel 301 shown in FIG. 10 simultaneously and the configuration of an apparatus corresponding to the characteristic adjustment are described in the following. Incidentally, the concepts of the preliminary drive processing and the characteristic adjustment to one device are the same as that of the first embodiment.

Figure 10:
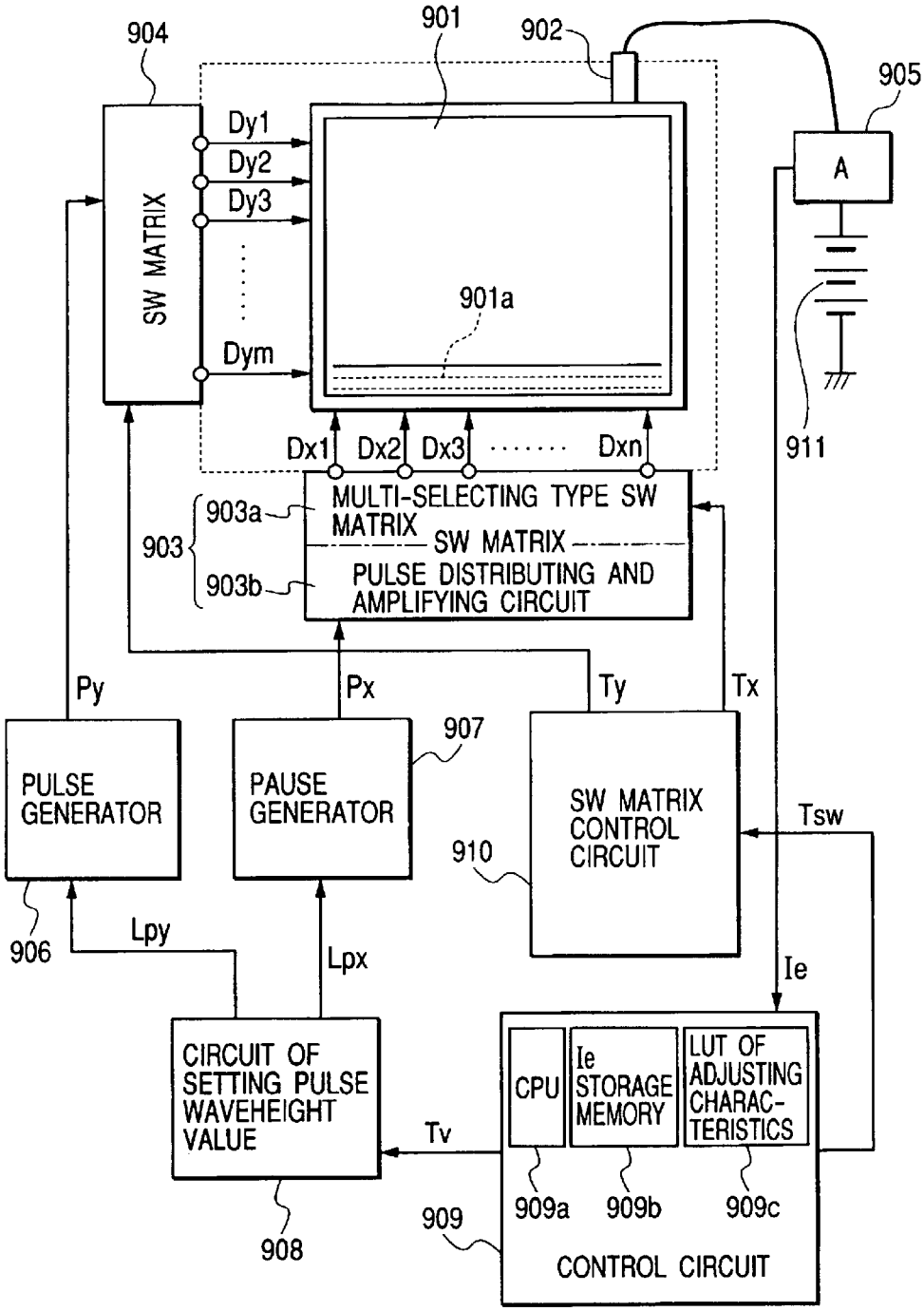
FIG. 10 is a schematic block diagram of an apparatus for adjusting characteristics of a multi-electron source according to an embodiment 2 of the present invention.

FIG. 10 is a block diagram of an apparatus for adjusting characteristics including a drive control circuit for changing the electron emission characteristics of respective electron-emitting devices by applying voltages for characteristic adjustment to a plurality of devices of a multi-electron source at the same time.

In FIG. 10, a reference numeral 901 designates a display panel. It is supposed that a plurality of surface conduction electron-emitting devices is wired in a passive matrix on the display panel 901 and the forming operation and the activation operation of the electron-emitting devices have already been completed and they are in their stabilization process. The display panel 901 disposes a substrate on which the plurality of the electron-emitting devices are disposed in a matrix, a face plate which is disposed above the substrate in a separate state from the substrate and has a phosphor emitting light by electrons emitted from the electron-emitting devices, and the like in a vacuum chamber. Moreover, these electron-emitting devices are connected with electric circuits on the outside through row-directional wiring terminals Dx1 to Dxn and column-directional wiring terminals Dy1 to Dym. A reference numeral 901*a* designates a part of a plurality of electron-emitting devices constituting the display panel 901. The part 901*a* of the electron-emitting devices shows devises used for obtaining data for characteristic adjustment. A reference numeral 902 designates a terminal for applying a high voltage from a high voltage source 911 to the phosphor of the display panel 901. A reference numeral 903 designates a switch matrix composed of a multi-selecting type switch matrix 903*a* capable of selecting one or more terminals in the row-directional wiring terminals Dx1 to Dxn and a pulse distributing amplifying circuit 903*b* for applying the same pulse waveform signal to the selected one or more terminals in the row direction. The switch matrix 903 will be described by the use of FIG. 11 later.

A reference numeral 904 designates a switch matrix for selecting any one of the column-directional wiring terminals Dy1 to Dym for selecting the column-directional wiring to apply a pulse waveform signal. Reference numerals 906 and 907 designate pulse generation circuits for generating pulse waveform signals Py and Px, respectively. A reference numeral 908 designates a circuit setting pulse wave heights. The circuit 908 determines the wave heights of pulse signals output from the pulse generation circuits 906 and 907 by outputting pulse setting signals Lpy and Lpx, respectively. A reference numeral 909 designates a control circuit. The control circuit 909 controls the whole of the flow of the characteristic adjustment. The control circuit 909 outputs data Tv for setting wave height values in the circuit setting pulse wave height 908. Incidentally, a reference numeral 909*a* designates a CPU. The CPU 909*a* controls the operations of the control circuit 909.

A reference numeral 909*b* designates a memory for storing the characteristics of each device for the characteristic adjustment of each device. To put it concretely, the memory 909*b* stores the electron-emitting current Ie of each device at the time of the application of the drive voltage Vdrv for display. A reference numeral 909*c* designates a look-up table for reference (an LUT for characteristic adjustment) made by obtaining data by applying a voltage to the part 901*a* of the devices. The look-up table 909*a* is referred at the time of the adjustment of characteristics.

A reference numeral 910 designates a switch matrix control circuit. The switch matrix control circuit 910 selects an electron-emitting device to which a pulse voltage is applied by controlling the selection of the switch matrices 903 and 904 by outputting switch switching signals Tx and Ty. respectively. Incidentally, the switch switching signal Tx is composed of a signal for selecting an arbitrary block in the block division, which will be described later, and a signal for selecting one or more switches in the block.

Figure 11:
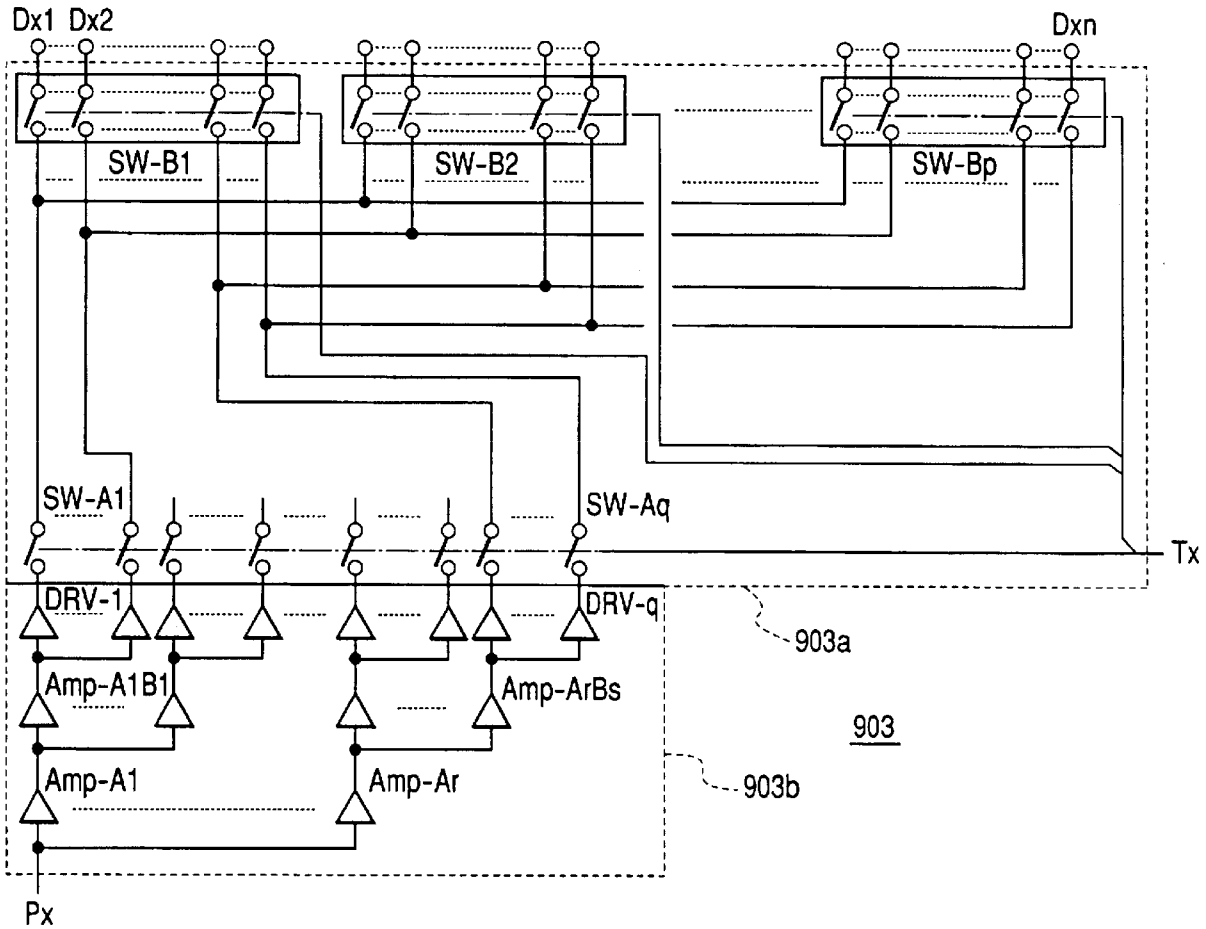
FIG. 11 is a circuit diagram showing the details of a switch matrix for a row directional selection in FIG. 10.

The switch matrix 903 is described on the basis of FIG. 11. In the present embodiment, the column direction is in the state in which only a certain terminal is selected, and the row direction adopts a block division method capable of many blocks in which one block region is composed of a plurality of devices being continuous up to q devices to which the same characteristic shift voltage is applied at the same time. The multi-selecting type switch matrix 903*a* has the structure capable of turning on a switch group constituting a block of switches in a lump at the same time. The block is formed by the division of the row-directional wiring terminals Dx1 to Dxn at every q terminals. The switches are connected to the row-directional wiring terminals Dx1 to Dxn in a one-to-one correspondence in order to be able to select only a certain selected block region. The block selection switch groups SW-B1, SW-B2, . . . , SW-Bp are installed in the multi-selecting type switch matrix 903*a*. For example, in the case where a block in the region of the row-directional wiring terminals Dx1 to Dxn to which the block selection switch group SW-1 is connected is selected, all of the switches in the block selection switch group SW-B1 are turned on, and all of the switches in the other block selection switch groups SW-B2 to SW-Bp are turned off.

Moreover, q terminal selection switches SW-A1 to SW-Aq are installed in the multi-selecting type switch matrix 903*a* for selecting arbitrary plural wiring terminals in a certain block. The terminal selection switches SW-A1 to SW-Aq are in the form of plural connection of one to p in which one switch in each block selection switch group is connected with one terminal selection switch. Thereby, an arbitrary terminal in a certain block can be selected. Moreover, because each terminal selection switch is made to have the structure capable of being independently turned on or off, the state in which arbitrary plural terminals in a certain block are selected at the same time can be realized.

Next, the pulse distributing amplifying circuit 903*b* are composed of circuits Amp-A1 to Amp-Ar. Amp-A1B1 to Amp-ArBs and DRV-1 to DRV-q that distribute and amplify the pulse waveform signal Px at multi-steps for making it possible to apply the pulse waveform signal Px set by the pulse generation circuit 907 equally to each of the terminal selection switches SW-A1 to SW-Aq configured in the multi-selecting type switch matrix 903*a*. The drivers DRV-1 to DRV-q are connected to the terminal selection switches SW-A1 to SW-Aq in a one-to-on correspondence. That is, the pulse waveform signal Px from the pulse generation circuit 907 are distributed as the same waveform to the terminal selection switches SW-A1 to SW-Aq by the pulse distributing amplifying circuit 903*b*. By the switch switching signal Tx from the switch matrix control circuit 910, one or more switches is selected among the terminal selection switches SW-A1 to SW-Aq, and a block selection switch group is selected among the block selection switch group SW-B1 to SW-Bp. Thereby, it becomes possible to apply the pulse waveform signal Px to one or more selected wiring terminals in the row direction of all of the devices in the display panel 901.

Figure 12:
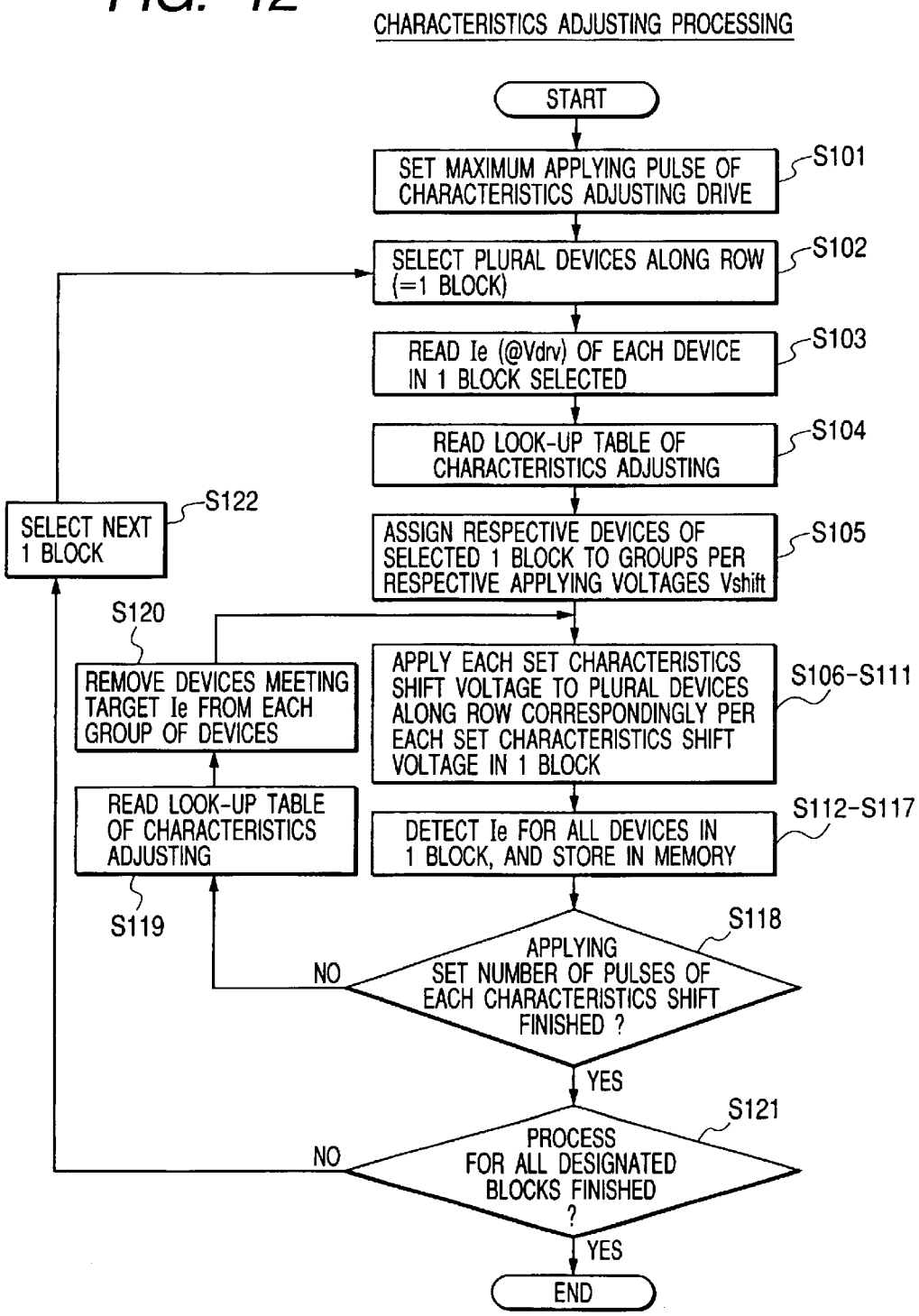
FIG. 12 is a flow chart of characteristic adjustment of the apparatus of FIG. 10.

On the basis of the switch matrices 903 and 904, the characteristic adjustment of all of the devices in the display panel 901 can be performed at every block in accordance with the following characteristic adjustment block transferring procedure. For example, by the switch matrix 904, first the first device in the column direction has been selected. Then, the first block in the row direction is selected by the block by the switch matrix 903 to perform the characteristic adjustment in the block region (FIG. 12). Then, when the characteristic adjustment of all of the devices in the block region has been completed, the characteristic adjustment is performed by shifting the block regions in the row direction in order while the selection of the first terminal in the column direction is being kept. When the characteristic adjustment of all of the blocks in the row direction has been completed, the next terminal in the column direction is selected by the switch matrix 904, and the block regions are shifted in order by the block in the column direction by the switch matrix 903. In such a way, by the selection of the last terminal in the column direction by the switch matrix 904, and by the performance of shifting the block regions in order in the row direction by the block by the switch matrix 903, the characteristic adjustment of all of the devices in the display panel 904 can be executed.

Moreover, in the procedure reverse to the above-mentioned procedure, in the switch matrix 903, first the first block in the row direction has been selected, and the terminals in the column direction are shifted in order from the first terminal in the column direction at every termination of the characteristic adjustment of one block by the switch matrix 904. When the selection of all of the terminals in the column direction has been completed, the next block in the row direction is selected by the switch matrix 903, and the terminals are shifted in order in the column direction by the switch matrix 904. In such a way, by the selection of the last block in the row direction by the switch matrix 903, and by the performance of shifting the terminals in order in the column direction by the switch matrix 904, the characteristic adjustment of all of the devices in the display panel 904 can be executed.

Next, a process flow for adjusting electron emission characteristic of an individual electron-emitting device constituting the multi-electron source is described. Incidentally, because the process of applying the preliminary drive voltage Vpre to all of the devices in the display panel 901, the process of measuring the electron emission characteristic at the time of the application of the drive voltage Vdrv after the application of the preliminary drive voltage Vpre, the first step of the process of setting the reference target electron emission current value Ie−t for adjusting the electron emission characteristic (corresponding to the flowchart of FIG. 5, and the preliminary drive period and the first period of the period of adjusting characteristics in FIG. 1A), and the second step of making a look-up table by introducing the change rate of the electron emission current at the time of the alternative application of the characteristic shift voltage Vshift and the drive voltage Vdrv to the devices in the part 901a of electron-emitting devices where images can be displayed without almost no influences by the use of the part 901*a* (corresponding to the flowchart of FIG. 6, and the second and the third periods of the period of adjusting characteristics in FIG. 1A) have been considered on the basis of the characteristic adjustment time (=a time for applying 10 pulses on an average) to one device shown in the first embodiment, their descriptions are omitted.

Figure 13:
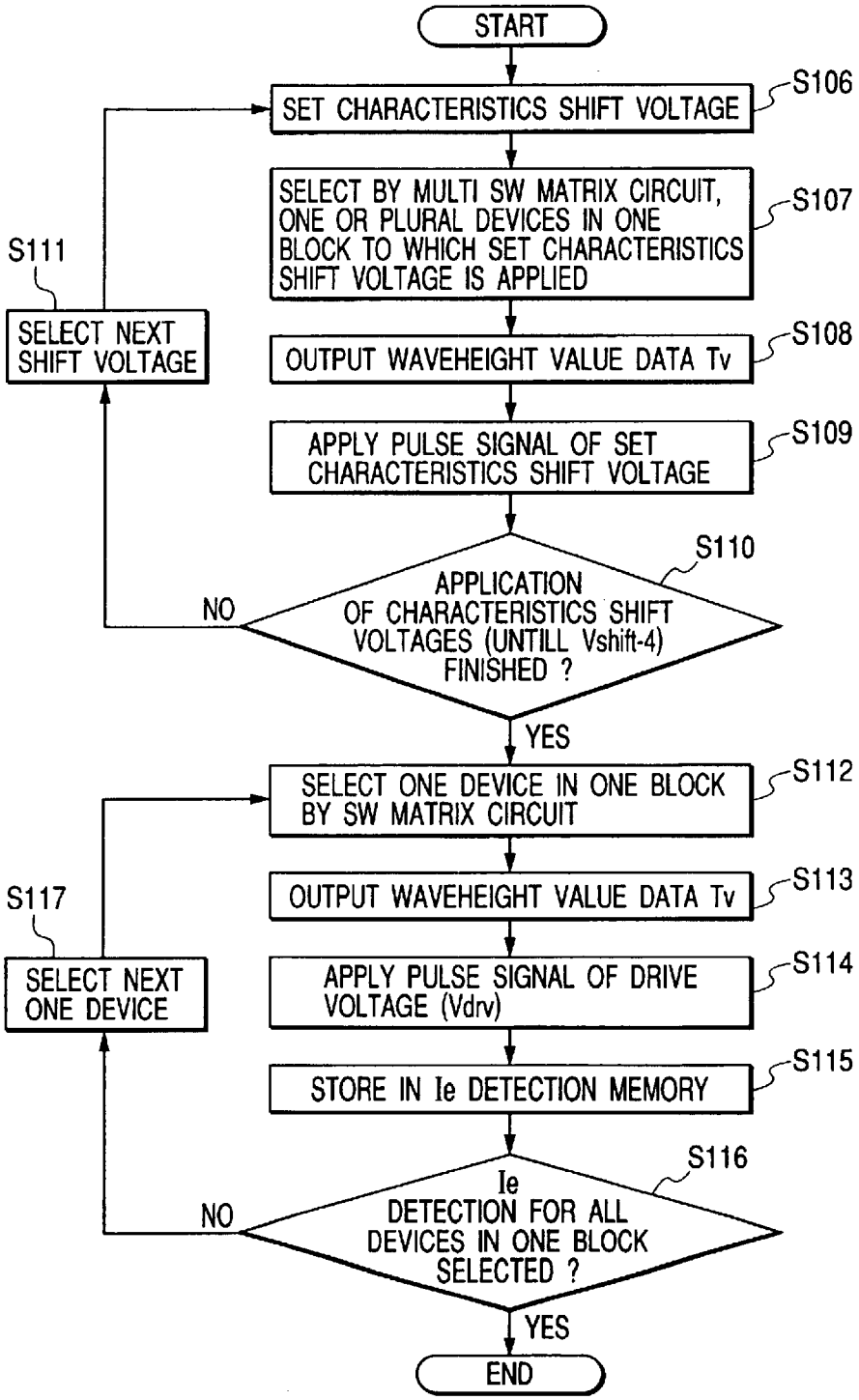
FIG. 13 is a flow chart showing a part of the flow chart of FIG. 12 in detail.
Figure 14:
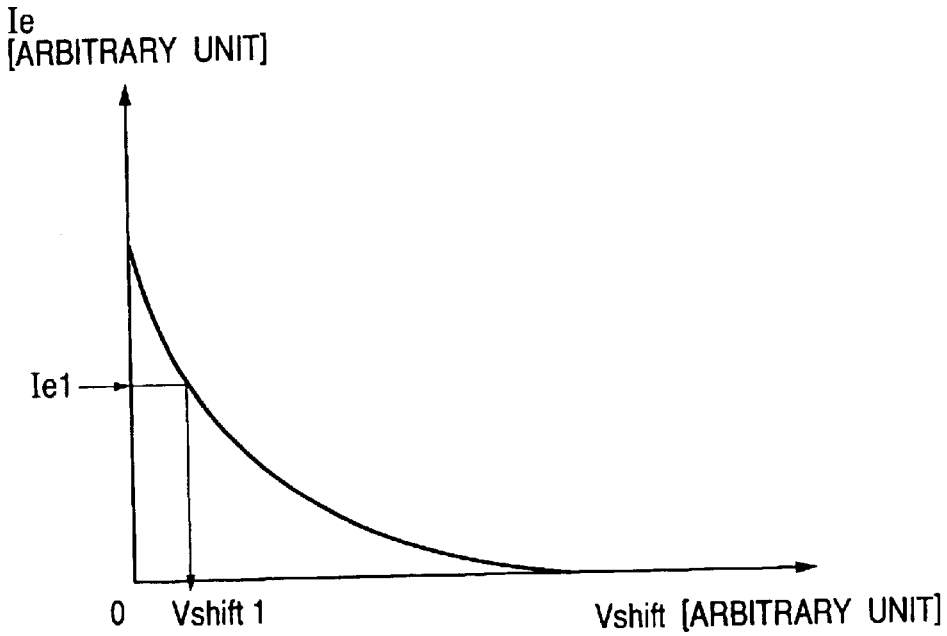
FIG. 14 is a graph showing an example of a characteristic changing curve of an electron emission current.

Because the characteristic adjustment procedure being the third step, namely applying the pulse waveform signal of the characteristic shift voltage Vshift to one or more devices simultaneously according to the look-up table for the characteristic adjustment and the step of measuring the electron emission characteristic by the application of the drive voltage Vdrv for judging whether the characteristic adjustment has been completed or not, differs from that of the first embodiment, the characteristic adjustment procedure is described by the use of the flowcharts of FIGS. 12 and 13. Incidentally, FIG. 13 is a flowchart for illustrating the flow from a step S105 to a step S117 in FIG. 12.

First, at a step S101, the maximum number of application pulses for performing the characteristic adjustment drive of a electron-emitting device, the characteristic adjustment of which is to be performed, in the display panel 901 is set. The maximum number of application pulses was set to be 20 pulses being twice as much as the average number of the application pulses. Next at a step S102, one block of the blocks having the block division configuration in the row direction of all of the devices in the display panel 901 is selected by the switch matrix 903 and a terminal in the column direction is selected. In the present embodiment, one block was composed of 288 devices (288 in row×1 in column). At a step S103, the electron emission current values Ie of a plurality of devices located in the selected block region at the time of the application of the drive voltage Vdrv after the preliminary drive of the devices are read out. At a step S104, the look-up table for characteristic adjustment 909*c* is read out. At a step S105, first a plurality of devices having the electron emission current values Ie equal to the reference target electron emission current value Ie−t or less are extracted among the plurality of devices located in the selected block read out at the step S103, and the extracted devices are set as a device group the characteristic adjustment of which is not executed. Next, a plurality of devices having the electron emission current values Ie larger than the reference target electron emission current value Ie−t among the plurality of devices located in the selected block read out at the step S103 are grouped by the assortment based on which characteristic shift voltage is to be applied among the characteristic shift voltages Vshift0 to Vshift4 corresponding to the electron emission current vales Ie of the devices by reference to the look-up table for characteristic adjustment read out at the step S104. That is, the plurality of devices in the block region is assorted to a device group Gr.0 to which the characteristic shift voltage value VshiftO is applied, a device group Gr.1 to which the characteristic shift voltage value Vshiftl is applied, a device group Gr.2 to which the characteristic shift voltage value Vshift2 is applied, a device group Gr.3 to which the characteristic shift voltage value Vshift3 is applied, and a device group Gr.4 to which the characteristic shift voltage value Vshift4 is applied. Then, at a step S106, the characteristic shift voltage selected at the previous step S105 being one of the characteristic shift voltage values Vshift0 to Vshift4 is set.

At a step S107, the switch matrix control signal Tsw is output from the switch matrix control circuit 910 in order to select one or more row-directional terminals and a column-directional terminal which row directional-terminals correspond to each device located in any one of the device groups Gr.0 to Gr.4 corresponding to the characteristic shift voltage set from any of the characteristic shift voltages Vshift0 to Vshift4. Then, the switch matrices 903 and 904 are switched on the basis of the switch matrix control signal Tsw to select one or more electron-emitting devices in the display panel 901. At a step S108, the waveform data Tv of the pulse signal to be applied to the selected one or more devices are output to the pulse wave height value setting circuit 908. At a step S109, the pulse generation circuits 906 and 907 apply the pulse signals of any of the characteristic shift voltage values Vshift0 to Vshift4 to the one or more electron-emitting devices that has been selected at the step S107 through the switch matrices 903 and 904. Hereupon, the characteristic shift voltage values Vshift0 to Vshift4 are applied in order. At a step S110, whether the characteristic shift voltage values Vshift0 to Vshift4 have been applied thoroughly or not is checked. Hereupon, if the characteristic shift voltage values Vshift0 to Vshift4 have been applied thoroughly, the process flow advances to a step S112. If the characteristic shift voltage values Vshift0 to Vshift4 have not been applied thoroughly yet, the process flow advances to a step S111. At the step S111, any of the characteristic shift voltage values Vshift0 to Vshift4 that has not been applied yet is selected, and the process flow advances to the step S106.

At a step S112, for performing the evaluation of the electron emission characteristics of all of the devices located in the block region selected at the step S102 at the time when the devices are driven by a voltage decreased to the drive voltage value Vdrv, the switch matrix control signal Tsw is output to switch the switch matrices 903 and 904 by the switch matrix control circuit 910 for selecting one device in the selected block. At a step S113, the drive voltage value Vdrv is set as the wave height value data Tv of the pulse signals to be applied to the selected device. Then, at a step S114, the pulse voltage of the drive voltage Vdrv is applied to the selected electron-emitting device. At a step S115, the electron emission current Ie at this time is measured to be stored in the memory 909*b*. At a step S116, whether the measurement of the electron emission current Ie is performed to all of the electron-emitting devices in the selected block region or not is examined. If the measurement has not been completed, the process flow advances to a step S117. At the step S117, the next device is selected, and the process flow advances to the step S112.

On the contrary, if the measurement of the electron emission current Ie has been performed to all of the devices in the selected block region, the process flow advances to a step S118. At the step S118, whether the accumulation number of application pulses to the devices in the selected block region has reached the set maximum number of application pulses for characteristic adjustment drive or not is checked. If the accumulation number has not reached the set maximum number yet, the process flow advances to a step S119. If the accumulation number has reached the set maximum number, the process flow advances to a step S121. At the step S119, the look-up table for character adjustment is read out like at the step S104. At the step S120, one or more devices having the electron emission current values Ie, measured and stored at the step S115, being equal to the reference target electron emission current value Ie−t in the characteristic adjustment or less are extracted among respective devices located in each of the groups Gr.0 to Gr.4 that has been grouped by assortment based on which characteristic shift voltage value is applied among the characteristic shift voltage values Vshift0 to Vshift4, and the extracted devices are re-set as a device group the characteristic adjustment of which is not executed. One or more devices having the electron emission current values Ie larger than the reference target electron emission current value Ie−t in the characteristic adjustment are set to remain in the group as they are. Then, the process flow advances to a step S106 for applying any one of the characteristic shift voltage Vshift0 to Vshift4 again. the step 121, whether the characteristic adjustment has been performed to all of the blocks into which devices in the display panel 901 has been assorted at the step S102 or not is checked. If there is a block the characteristic adjustment of which has not been performed yet, the process flow advances to a step S122. At the step S122, the next block the characteristic adjustment of which has not been performed yet is selected in accordance with the above-mentioned procedure of shifting characteristic adjustment blocks or the like, and the process flow advances to the step S102. If the characteristic adjustment of all of the blocks has been performed at the step 121, the characteristic adjustment is completed. And, the electron emission currents of all of the devices become equal. Now, if the application of the characteristic shift voltages are compared in the embodiments 1 and 2, in the case where the pulse of the characteristic shift voltage is applied to each of the 288 devices in one block once, the total number of times of pulse application is 288 times in the embodiment 1. On the other hand, in the embodiment 2, the total number of times decreases to 5 times. That is, the time of the application of the characteristic shift voltages can be shortened in the second embodiment.

Incidentally, although, in the embodiments 1 and 2, the characteristic adjustment is performed by measuring the electron emission currents to make the measured currents equal, the characteristic adjustment may be performed by measuring the luminous brightness of a phosphor emitting light by electrons emitted from the devices to make the dispersion of the brightness uniform if it exists. That is, the equalization can also be realized by measuring the luminous brightness of the phosphor emitting light by the electrons emitted from a driven device at every drive of each of the electron-emitting devices to convert the measured brightness to a value equivalent to the electron emission current.

Moreover, although, in the embodiments 1 and 2, the characteristic shift voltage is applied to the parts 301*a* and 901*a* of the devices in the image display area in the display panel for making the look-up table for characteristic adjustment by the use of the parts 301*a* and 901*a*, dummy devices which are not driven at the time of image display may be made in the display panel to obtain the data. Moreover, the data can be obtained from devices of another display panel formed by the same process as the display panel to be adjusted.

According to the present invention, as described above, the dispersion of the electron emission characteristics of the electron-emitting devices of a multi-electron source can be suppressed by a relatively simple method with good reproducibility.

Moreover, because the unevenness of the adjustment time that has been generated owing to the differences of characteristics of respective devices can be suppressed, the versatility of the adjustment method becomes large and the management of the manufacturing processes of electron sources become easy.

Then, an electron source in which surface conduction electron-emitting devices were disposed on a substrate in a matrix was made in conformity with the method disclosed in U.S. Pat. No. 6,231,412. A display panel was made by fabricating vacuum chamber to be one body with a plate having a phosphor as the need arisen. After that, the characteristic adjustment methods according to each of the above-mentioned embodiments were performed. Consequently, the display state in which the brightness is equal could be obtained.

What is claimed is:

1. A method for adjusting characteristics of an electron source having a plurality of electron-emitting devices, said method comprising the step of:

applying a pulse of a voltage for adjustment to an electron-emitting device to be adjusted one or more times according to a characteristic of said electron-emitting device;

wherein:

said voltage for adjustment is selected from a plurality of voltages having discrete values according to said characteristic of said electron-emitting device; and a number of applying times of said pulse is determined according to said characteristic of said electron-emitting device and said selected voltage.

2. A method for adjusting characteristics of an electron source according to claim 1, said method further comprising the step of:

preparing a characteristic adjustment table for connecting said voltage for adjustment with said electron-emitting device on a basis of a change rate of said characteristic of said electron-emitting device changing according to said number of applying times of each voltage at every voltage in said plurality of voltages, wherein said step of applying said pulse to said electron-emitting device to be adjusted is performed by referring to said characteristic adjustment table while selecting said voltage for adjustment according to the characteristic of said electron-emitting device.

3. A method for adjusting characteristics of an electron source according to claim 2, wherein said characteristic adjustment table is made on a basis of data obtained from said electron-emitting device to be adjusted, said electron-emitting device being selected from said electron source.

4. A method for adjusting characteristics of an electron source according to claim 2, said method further comprising the step of:

measuring said characteristic of said electron-emitting device to be adjusted at every application of said pulse of said voltage for adjustment to bring said characteristic close to a target value.

5. A method for adjusting characteristics of an electron source according to claim 1, wherein said step of applying said pulse of said voltage for adjustment is performed in an atmosphere in which a partial pressure of an organic gas is $10^{-6}$ Pa or less.

6. A method for adjusting characteristics of an electron source according to claim 1, wherein said step of applying said pulse is performed to apply said pulse of said voltage for adjustment simultaneously to a plurality of electron-emitting devices to which said selected voltage for adjustment is the same.

7. An apparatus for adjusting characteristics of an electron source, said apparatus comprising:

a drive control circuit for executing a method for adjusting characteristics of said electron source according to claim 1.

8. An apparatus for adjusting characteristics of an electron source according to claim 7, said apparatus further comprising:

storage means for storing a characteristic adjustment table;

drive circuit for applying a voltage for adjustment; and a control circuit for performing selection of said voltage for adjustment and determination of a number of applying times of said voltage.

9. A method for manufacturing an electron source having a plurality of electron-emitting devices, said method comprising the steps of:

manufacturing said plurality of electron-emitting devices on a substrate;

measuring characteristics of said plurality of electron-emitting devices; and executing a method for adjusting said characteristics of said electron source according to claim 1.

10. A method for manufacturing an electron source according to claim 9, wherein said step of executing said method for adjusting said characteristics is executed after fabricating said electron source and a plate having a phosphor.

11. A method for manufacturing an electron source according to claim 9, said method further comprising the step of:

preparing a characteristic adjustment table for connecting said voltage for adjustment with said electron-emitting device on a basis of a change rate of said characteristic of said electron-emitting device changing according to said number of applying times of each voltage at every voltage in said plurality of voltages, wherein said step of applying said pulse to said electron-emitting device to be adjusted is performed by referring to said characteristic adjustment table while selecting said voltage for adjustment according to the characteristic of said electron-emitting device.

12. A method for manufacturing an electron source according to claim 11, wherein said characteristic adjustment table is made on a basis of data obtained from said electron-emitting device to be adjusted, said electron-emitting device being selected from said electron source.

13. A method for adjusting characteristics of an electron source according to claim 11, wherein said step of measuring said characteristic is performed to measure said electron-emitting device to be adjusted at every application of said pulse of said voltage for adjustment to bring said characteristic close to a target value.

14. A method for manufacturing an electron source according to claim 9, wherein said step of applying said pulse of said voltage for adjustment is performed in an atmosphere in which a partial pressure of an organic gas is $10^{-6}$ Pa or less.

15. A method for manufacturing an electron source according to claim 9, wherein said step of applying said pulse is performed to apply said pulse of said voltage for adjustment simultaneously to a plurality of electron-emitting devices to which said selected voltage for adjustment is the same.

* * * * *

UNITED STATES PATENT AND TRADEMARK OFFICE

CERTIFICATE OF CORRECTION

PATENT NO. : 6,712,660 B2
DATED : March 30, 2004
INVENTOR(S) : Shuji Aoki et al.

It is certified that error appears in the above-identified patent and that said Letters Patent is hereby corrected as shown below:

Column 3,
Line 43, "sate" should read -- state --.

Column 5,
Line 54, "Vf Vshift" should read -- Vf = Vshift --.

Column 6,
Line 41, "referred" should read -- referred to --.

Column 7,
Line 65, "the adjustment" should read -- adjustment is made of --.

Column 9,
Line 1, "at" should read -- to at --; and
Line 44, "as a threshold value" should read -- a "threshold value," --.

Column 10,
Line 56, "store" should read -- stored --; and
Line 59, "has" should read -- have --.

Column 12,
Line 10, "value" should read -- values --.

Column 14,
Line 2, "Vshit1" should read -- Vshift1 --;
Lines 11, 20, 28 and 37, "to" should read -- to be --; and
Line 37, "DO," should read -- D0, --.

Column 19,
Line 10, "are" should read -- is --; and
Line 18, "one-to-on" should read -- one-to-one --.

Column 21,
Line 2, "VshiftO" should read -- Vshift0 --.

Column 22,
Line 17, "the step" should read -- At step --; and
Line 19, "has" should read -- have --.

UNITED STATES PATENT AND TRADEMARK OFFICE

CERTIFICATE OF CORRECTION

PATENT NO. : 6,712,660 B2
DATED : March 30, 2004
INVENTOR(S) : Shuji Aoki et al.

It is certified that error appears in the above-identified patent and that said Letters Patent is hereby corrected as shown below:

Column 23,
Line 3, "become" should read -- becomes --; and
Line 8, "arisen." should read -- arose. --.

Signed and Sealed this

Seventh Day of June, 2005

JON W. DUDAS
*Director of the United States Patent and Trademark Office*